US010809651B2

(12) United States Patent
Furuichi

(10) Patent No.: US 10,809,651 B2
(45) Date of Patent: Oct. 20, 2020

(54) HEATING DEVICE, FIXING DEVICE, AND IMAGE FORMING APPARATUS

(71) Applicant: Yuusuke Furuichi, Kanagawa (JP)

(72) Inventor: Yuusuke Furuichi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/655,367

(22) Filed: Oct. 17, 2019

(65) Prior Publication Data

US 2020/0174407 A1 Jun. 4, 2020

(30) Foreign Application Priority Data

Nov. 29, 2018 (JP) ..... 2018-223605

(51) Int. Cl.
*G03G 15/20* (2006.01)

(52) U.S. Cl.
CPC ..... *G03G 15/2039* (2013.01); *G03G 15/2025* (2013.01); *G03G 15/2042* (2013.01)

(58) Field of Classification Search
CPC ..... G03G 15/2025; G03G 15/2039; G03G 15/2042
See application file for complete search history.

(56) References Cited

U.S. PATENT DOCUMENTS

2004/0265021 A1* 12/2004 Kinouchi ..... G03G 15/2042 399/334
2013/0279932 A1* 10/2013 Ishigai ..... G03G 15/2039 399/69
2014/0076878 A1* 3/2014 Shimura ..... G03G 15/2039 219/216
2015/0037052 A1* 2/2015 Muramatsu ..... G03G 15/2042 399/45
2017/0060052 A1* 3/2017 Narahara ..... G03G 15/2039
2018/0032008 A1* 2/2018 Sako ..... G03G 15/2039
(Continued)

FOREIGN PATENT DOCUMENTS

JP 2015-166795 9/2015
JP 2017-092039 5/2017

OTHER PUBLICATIONS

U.S. Appl. No. 16/520,409, filed Jul. 24, 2019, Hiroshi Yoshinaga , et al.

(Continued)

*Primary Examiner* — Sophia S Chen
(74) *Attorney, Agent, or Firm* — Oblon, McClelland, Maier & Neustadt, L.L.P.

(57) ABSTRACT

A heating device includes an endless belt that rotates in a rotation direction and a pressure rotator that contacts an outer circumferential surface of the endless belt to form a nip between the endless belt and the pressure rotator. A heater sandwiches a lubricant together with the endless belt. The heater includes a heat generator that defines a conveyance span in a longitudinal direction of the heater, where a heating target having a predetermined width in the longitudinal direction of the heater is conveyed through the nip, and a non-conveyance span in the longitudinal direction of the heater, where the heating target is not conveyed. A non-conveyance span temperature detector is disposed opposite the endless belt in the non-conveyance span of the heat generator. The non-conveyance span temperature detector detects a temperature of the endless belt.

20 Claims, 16 Drawing Sheets

(56) References Cited

U.S. PATENT DOCUMENTS

| | | | |
|---|---|---|---|
| 2019/0278206 | A1 | 9/2019 | Adachi et al. |
| 2019/0286026 | A1 | 9/2019 | Furuichi et al. |
| 2019/0286028 | A1 | 9/2019 | Furuichi et al. |
| 2019/0286029 | A1 | 9/2019 | Adachi et al. |

OTHER PUBLICATIONS

U.S. Appl. No. 16/519,254, filed Jul. 23, 2019, Daisuke Inoue , et al.
U.S. Appl. No. 16/502,348, filed Jul. 3, 2019, Yuusuke Furuichi , et al.
U.S. Appl. No. 16/502,473, filed Jul. 3, 2019, Yuusuke Furuichi , et al.
U.S. Appl. No. 16/391,959, filed Apr. 23, 2019, Takamasa Hase , et al.
U.S. Appl. No. 16/451,512, filed Jun. 25, 2019, Tomoya Adachi , et al.

* cited by examiner

HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-223605, filed on Nov. 29, 2018, in the Japan Patent Office, the entire disclosure of which is hereby incorporated by reference herein.

BACKGROUND

Technical Field

Exemplary aspects of the present disclosure relate to a heating device, a fixing device, and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a heating device such as a fixing device that fixes a toner image on a sheet serving as a recording medium under heat and a dryer that dries ink on a sheet.

For example, the fixing device includes a laminated heater. The fixing device further includes a thermistor serving as a temperature detecting element. The thermistor contacts a back face of a substrate of the laminated heater, detecting the temperature of the laminated heater.

The heating device includes a laminated heater that contacts and heats a belt that rotates. While the belt rotates, the belt slides over the laminated heater. Hence, a lubricant such as heat resistant grease is interposed between the belt and the laminated heater to facilitate smooth rotation of the belt.

However, in a non-conveyance span where a heating target, that is, a recording medium, is not conveyed over the belt and the laminated heater, the heating target may barely draw heat from the laminated heater and the belt, resulting in overheating of the laminated heater and the belt. In this case, if a temperature detector such as a thermistor does not detect the temperature of the lubricant precisely, the temperature of the lubricant may increase to a temperature higher than a heat resistant temperature of the lubricant, degrading performance of the lubricant.

SUMMARY

This specification describes below an improved heating device. In one embodiment, the heating device includes an endless belt that rotates in a rotation direction and a pressure rotator that contacts an outer circumferential surface of the endless belt to form a nip between the endless belt and the pressure rotator. A heater sandwiches a lubricant together with the endless belt. The heater includes a heat generator that defines a conveyance span in a longitudinal direction of the heater, where a heating target having a predetermined width in the longitudinal direction of the heater is conveyed through the nip, and a non-conveyance span in the longitudinal direction of the heater, where the heating target is not conveyed. A non-conveyance span temperature detector is disposed opposite the endless belt in the non-conveyance span of the heat generator. The non-conveyance span temperature detector detects a temperature of the endless belt.

This specification further describes an improved fixing device. In one embodiment, the fixing device includes an endless belt that rotates in a rotation direction and a pressure rotator that contacts an outer circumferential surface of the endless belt to form a nip between the endless belt and the pressure rotator. A laminated heater sandwiches a lubricant together with the endless belt. The laminated heater includes a heat generator that defines a conveyance span in a longitudinal direction of the laminated heater, where a recording medium having a predetermined width in the longitudinal direction of the laminated heater is conveyed through the nip, and a non-conveyance span in the longitudinal direction of the laminated heater, where the recording medium is not conveyed. A non-conveyance span temperature detector is disposed opposite the endless belt in the non-conveyance span of the heat generator. The non-conveyance span temperature detector detects a temperature of the endless belt.

This specification further describes an improved image forming apparatus. In one embodiment, the image forming apparatus includes an image forming device that forms an image and a heating device that heats the image borne on a heating target. The heating device includes an endless belt that rotates in a rotation direction and a pressure rotator that contacts an outer circumferential surface of the endless belt to form a nip between the endless belt and the pressure rotator. A heater sandwiches a lubricant together with the endless belt. The heater includes a heat generator that defines a conveyance span in a longitudinal direction of the heater, where the heating target having a predetermined width in the longitudinal direction of the heater is conveyed through the nip, and a non-conveyance span in the longitudinal direction of the heater, where the heating target is not conveyed. A non-conveyance span temperature detector is disposed opposite the endless belt in the non-conveyance span of the heat generator. The non-conveyance span temperature detector detects a temperature of the endless belt.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
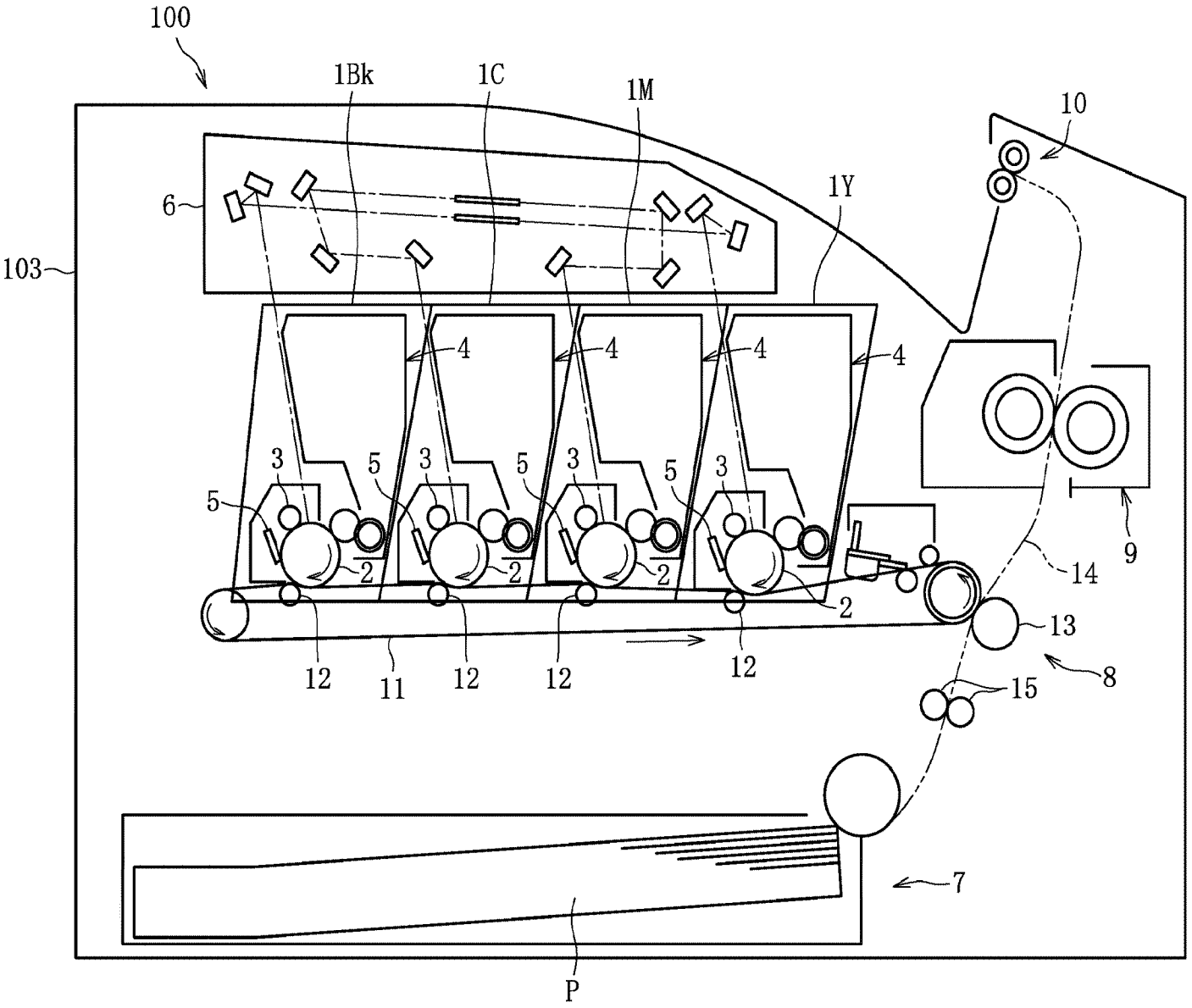
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to the attached drawings, the following describes a construction of an image forming apparatus 100 according to embodiments of the present disclosure.

In the drawings for explaining the embodiments of the present disclosure, identical reference numerals are assigned to elements such as members and parts that have an identical function or an identical shape as long as differentiation is possible and a description of those elements is omitted once the description is provided.

FIG. 1 is a schematic cross-sectional view of the image forming apparatus 100 according to an embodiment of the present disclosure. The image forming apparatus 100 is a printer. Alternatively, the image forming apparatus 100 may be a copier, a facsimile machine, a multifunction peripheral (MFP) having at least two of printing, copying, facsimile, scanning, and plotter functions, or the like.

As illustrated in FIG. 1, the image forming apparatus 100 includes four image forming units 1Y, 1M, 1C, and 1Bk serving as image forming devices, respectively. The image forming units 1Y, 1M, 1C, and 1Bk are removably installed in a body 103 of the image forming apparatus 100. The image forming units 1Y, 1M, 1C, and 1Bk have a similar construction except that the image forming units 1Y, 1M, 1C, and 1Bk contain developers in different colors, that is, yellow, magenta, cyan, and black, respectively, which correspond to color separation components for a color image. For example, each of the image forming units 1Y, 1M, 1C, and 1Bk includes a photoconductor 2, a charger 3, a developing device 4, and a cleaner 5. The photoconductor 2 is drum-shaped and serves as an image bearer. The charger 3 charges a surface of the photoconductor 2. The developing device 4 supplies toner as a developer to the surface of the photoconductor 2 to form a toner image. The cleaner 5 cleans the surface of the photoconductor 2.

The image forming apparatus 100 further includes an exposure device 6, a sheet feeding device 7, a transfer device 8, a fixing device 9, and a sheet ejection device 10. The exposure device 6 exposes the surface of each of the photoconductors 2 and forms an electrostatic latent image thereon. The sheet feeding device 7 supplies a sheet P serving as a recording medium or a heating target to the transfer device 8. The transfer device 8 transfers the toner image formed on each of the photoconductors 2 onto the sheet P. The fixing device 9 fixes the toner image transferred onto the sheet P thereon. The sheet ejection device 10 ejects the sheet P onto an outside of the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor stretched taut across a plurality of rollers. The four primary transfer rollers 12 serve as primary transferors that transfer yellow, magenta, cyan, and black toner images formed on the photoconductors 2 onto the intermediate transfer belt 11, respectively, thus forming a full color toner image on the intermediate transfer belt 11. The secondary transfer roller 13 serves as a secondary transferor that transfers the full color toner image formed on the intermediate transfer belt 11 onto the sheet P. The plurality of primary transfer rollers 12 is pressed against the photoconductors 2, respectively, via the intermediate transfer belt 11. Thus, the intermediate transfer belt 11 contacts each of the photoconductors 2, forming a primary transfer nip therebetween. On the other hand, the secondary transfer roller 13 is pressed against one of the rollers across which the intermediate transfer belt 11 is stretched taut via the intermediate transfer belt 11. Thus, a secondary transfer nip is formed between the secondary transfer roller 13 and the intermediate transfer belt 11.

The image forming apparatus 100 accommodates a sheet conveyance path 14 through which the sheet P fed from the sheet feeding device 7 is conveyed. A timing roller pair 15 is disposed in the sheet conveyance path 14 at a position between the sheet feeding device 7 and the secondary transfer nip defined by the secondary transfer roller 13.

Referring to FIG. 1, a description is provided of printing processes performed by the image forming apparatus 100 having the construction described above.

When the image forming apparatus 100 receives an instruction to start printing, a driver drives and rotates the photoconductor 2 clockwise in FIG. 1 in each of the image forming units 1Y, 1M, 1C, and 1Bk. The charger 3 charges the surface of the photoconductor 2 uniformly at a high electric potential. Subsequently, the exposure device 6 exposes the surface of each of the photoconductors 2 based on image data created by an original scanner that reads an image on an original or print data instructed by a terminal, thus decreasing the electric potential of an exposed portion on the photoconductor 2 and forming an electrostatic latent image on the photoconductor 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 in accordance with rotation of the photoconductors 2, respectively, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon. Thereafter, the full color toner image formed on the intermediate transfer belt 11 is conveyed to the secondary transfer nip defined by the secondary transfer roller 13 in accordance with rotation of the intermediate transfer belt 11 and is transferred onto a sheet P conveyed to the secondary transfer nip. The sheet P is supplied from the sheet feeding device 7. The timing roller pair 15 temporarily halts the sheet P supplied from the sheet feeding device 7. Thereafter, the timing roller pair 15 conveys the sheet P to the secondary transfer nip at a time when the full color toner image formed on the intermediate transfer belt 11 reaches the secondary transfer nip. Accordingly, the full color toner image is transferred onto and borne on the sheet P. After the toner image is transferred onto the intermediate transfer belt 11, the cleaner 5 removes residual toner remained on the photoconductor 2 therefrom.

The sheet P transferred with the full color toner image is conveyed to the fixing device 9 that fixes the full color toner image on the sheet P. Thereafter, the sheet ejection device 10 ejects the sheet P onto the outside of the image forming apparatus 100, thus finishing a series of printing processes.

A description is provided of a construction of the fixing device 9.

Figure 2:
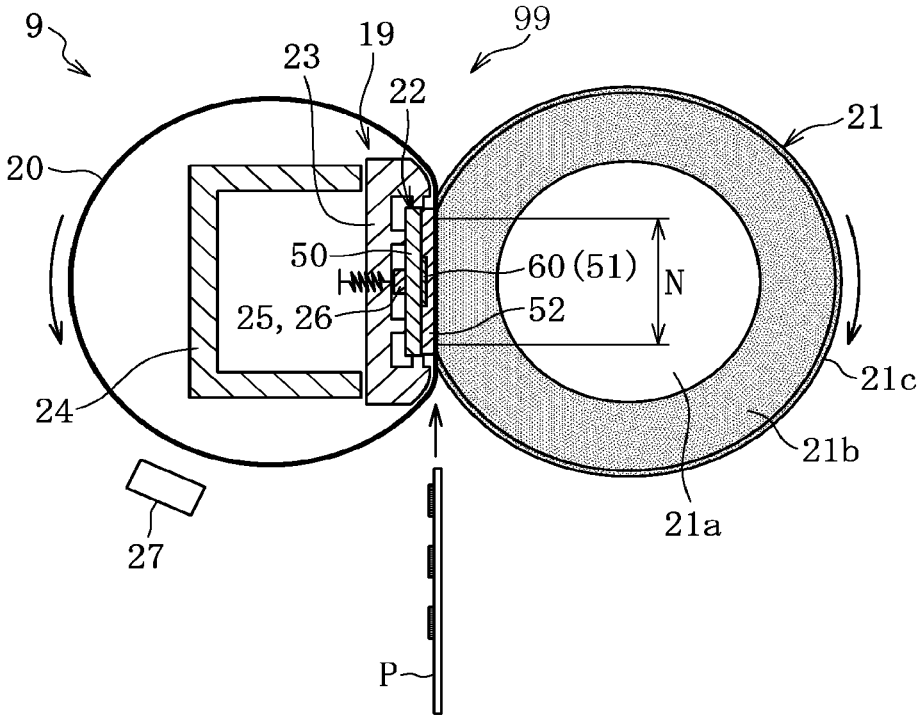
FIG. 2 is a schematic cross-sectional view of a fixing device incorporated in the image forming apparatus depicted in FIG. 1.

As illustrated in FIG. 2, the fixing device 9 according to this embodiment includes a fixing belt 20, a pressure roller 21, and a heating device 19. The fixing belt 20 is an endless belt serving as a fixing rotator or a fixing member. The pressure roller 21 serves as a pressure rotator that contacts an outer circumferential surface of the fixing belt 20 to form a fixing nip N between the fixing belt 20 and the pressure roller 21. The heating device 19 heats the fixing belt 20. The heating device 19 includes a heater 22, a heater holder 23, a stay 24, and a plurality of thermistors, that is, a first thermistor 25, a second thermistor 26, and a third thermistor 27. The heater 22 is a laminated heater and serves as a heater or a heating member. The heater holder 23 serves as a holder that holds or supports the heater 22. The stay 24 serves as a reinforcement that reinforces the heater holder 23 throughout an entire width of the heater holder 23 in a longitudinal direction thereof. Each of the first thermistor 25, the second thermistor 26, and the third thermistor 27 serves as a temperature detector. Alternatively, the fixing device 9 may be a heating device 99 that incorporates the fixing belt 20, the pressure roller 21, and the heating device 19.

A detailed description is now given of a construction of the fixing belt 20.

Figure 3:
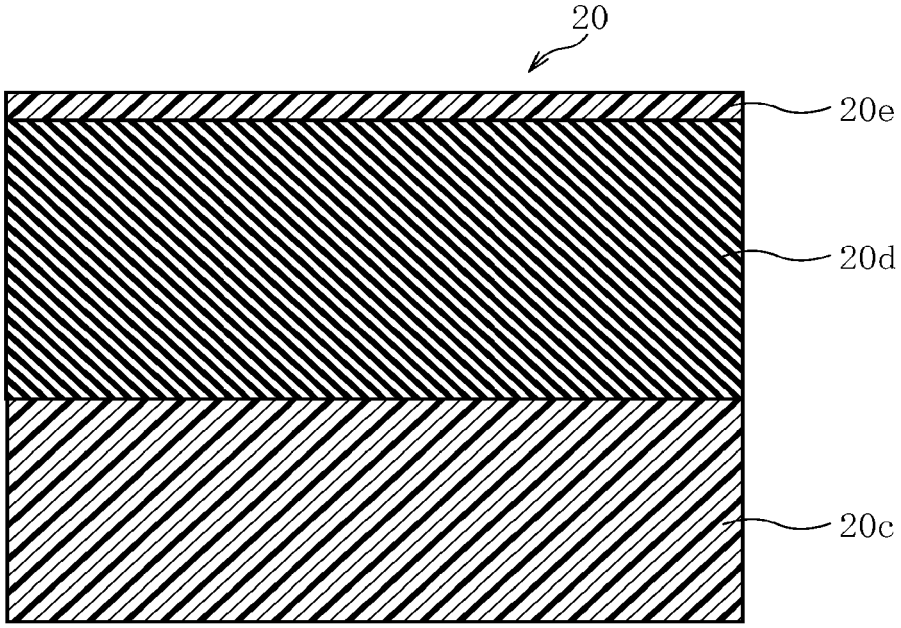
FIG. 3 is a cross-sectional view of a fixing belt incorporated in the fixing device depicted in FIG. 2.

FIG. 3 is a cross-sectional view of the fixing belt 20. As illustrated in FIG. 3, the fixing belt 20 includes a tubular base 20*c* that is made of polyimide (PI) and has an outer diameter of 25 mm and a thickness in a range of from 40 micrometers to 120 micrometers, for example. The fixing belt 20 further includes a release layer 20*e* serving as an outermost surface layer. The release layer 20*e* is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 20 and facilitate separation of the sheet P and a foreign substance from the fixing belt 20.

Optionally, an elastic layer 20*d* that is made of rubber or the like and has a thickness in a range of from 50 micrometers to 500 micrometers may be disposed on an outer periphery of the base 20*c* and interposed between the base 20*c* and the release layer 20*e*. The base 20*c* of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a slide layer.

A detailed description is now given of a construction of the pressure roller 21.

The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* is disposed on a surface (e.g., an outer periphery) of the cored bar 21*a*. The release layer 21*c* coats an outer surface (e.g., an outer periphery) of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*. Alternatively, instead of the pressure roller 21, an endless pressure belt or the like may be employed as a pressure rotator that presses against the fixing belt 20.

A detailed description is now given of a construction of the heater 22.

The heater 22 extends in a longitudinal direction thereof throughout an entire width of the fixing belt 20 in a width direction, that is, an axial direction, of the fixing belt 20. The heater 22 contacts the inner circumferential surface of the fixing belt 20. The heater 22 may not contact the fixing belt 20 or may be disposed opposite the fixing belt 20 indirectly via a low friction sheet or the like. However, the heater 22 that contacts the fixing belt 20 directly enhances conduction of heat from the heater 22 to the fixing belt 20. The heater 22 may contact the outer circumferential surface of the fixing belt 20. However, if the outer circumferential surface of the fixing belt 20 is brought into contact with the heater 22 and damaged, the fixing belt 20 may degrade quality of fixing the toner image on the sheet P. Hence, the heater 22 contacts the inner circumferential surface of the fixing belt 20 advantageously. The heater 22 includes a base layer 50, a conductor layer 51, and an insulating layer 52. The conductor layer 51 includes a heat generator 60. The base layer 50, the conductor layer 51, and the insulating layer 52 are layered in this order from a side of the heater 22, that faces the heater holder 23, to a side of the heater 22, that faces the fixing nip N.

A detailed description is now given of a construction of the heater holder 23 and the stay 24.

The heater holder 23 and the stay 24 are disposed inside a loop formed by the fixing belt 20. The stay 24 includes a channel made of metal. Both lateral ends of the stay 24 in a longitudinal direction thereof are supported by side walls (e.g., side plates) of the fixing device 9, respectively. The stay 24 supports a stay side face of the heater holder 23, that faces the stay 24 and is opposite a heater side face of the heater holder 23, that faces the heater 22. Accordingly, the stay 24 retains the heater 22 and the heater holder 23 to be immune from being bent substantially by pressure from the pressure roller 21, forming the fixing nip N between the fixing belt 20 and the pressure roller 21.

Since the heater holder 23 is subject to temperature increase by heat from the heater 22, the heater holder 23 is preferably made of a heat resistant material. For example, if the heater holder 23 is made of heat resistant resin having a decreased thermal conductivity, such as liquid crystal polymer (LCP) and PEEK, the heater holder 23 suppresses conduction of heat thereto from the heater 22, facilitating heating of the fixing belt 20.

A spring serving as a biasing member causes the fixing belt 20 and the pressure roller 21 to press against each other. Thus, the fixing nip N is formed between the fixing belt 20 and the pressure roller 21. As a driving force is transmitted to the pressure roller 21 from a driver disposed inside the body 103 of the image forming apparatus 100, the pressure roller 21 serves as a driving roller that drives and rotates the fixing belt 20. The fixing belt 20 is driven and rotated by the pressure roller 21 as the pressure roller 21 rotates. While the fixing belt 20 rotates, the fixing belt 20 slides over the heater 22. Hence, in order to facilitate sliding of the fixing belt 20, a lubricant such as oil and grease is interposed between the heater 22 and the fixing belt 20. Fluorine grease, silicone grease, fluorine oil, silicone oil, or the like is preferably used as the lubricant. For example, the fluorine grease is resistant against high temperatures and retains viscosity even when the fluorine grease has a high temperature. Thus, the fluorine grease as the lubricant does not flow out of each lateral end of the fixing belt 20 in the axial direction thereof.

When printing starts, the driver drives and rotates the pressure roller 21 and the fixing belt 20 starts rotation in accordance with rotation of the pressure roller 21. Additionally, as power is supplied to the heater 22, the heater 22 heats the fixing belt 20. In a state in which the temperature of the fixing belt 20 reaches a predetermined target temperature (e.g., a fixing temperature), as a sheet P bearing an unfixed toner image is conveyed through the fixing nip N formed between the fixing belt 20 and the pressure roller 21 as illustrated in FIG. 2, the fixing belt 20 and the pressure roller 21 fix the unfixed toner image on the sheet P under heat and pressure.

Figure 4:
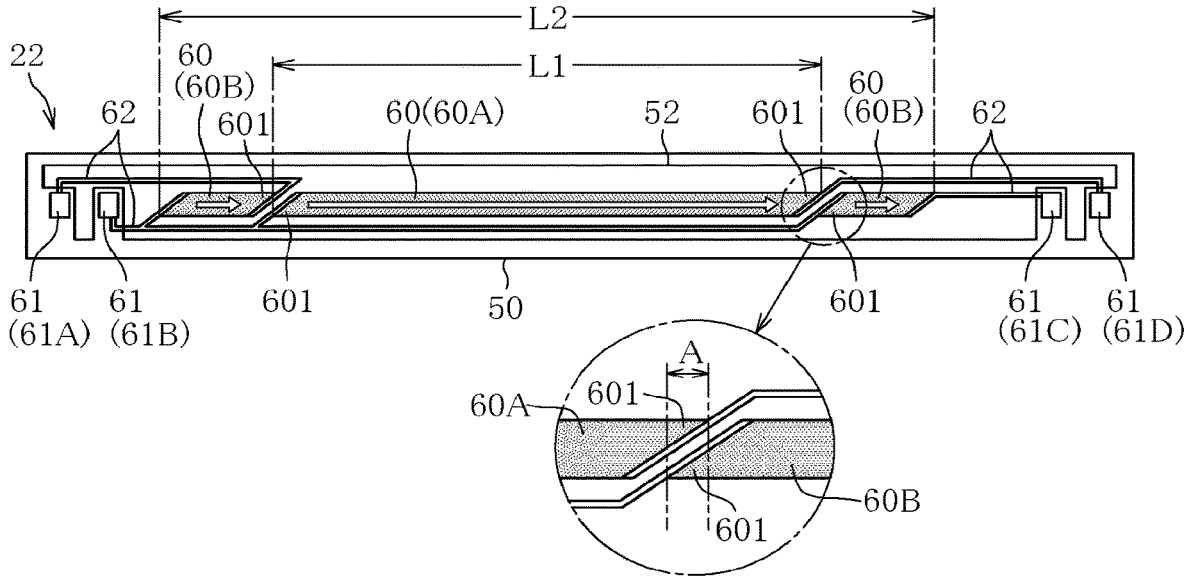
FIG. 4 is a plan view of a heater incorporated in the fixing device depicted in FIG. 2.
Figure 5:
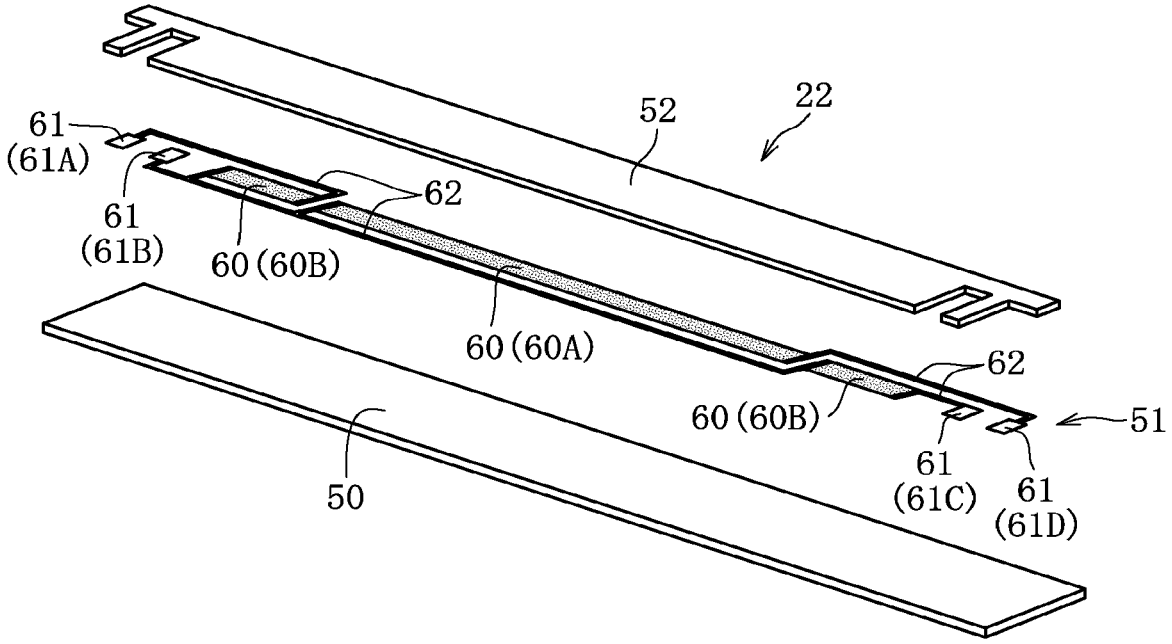
FIG. 5 is an exploded perspective view of the heater depicted in FIG. 4.

FIG. 4 is a plan view of the heater 22. FIG. 5 is an exploded perspective view of the heater 22.

Hereinafter, a front side of the heater 22 defines a side that faces the fixing belt 20 and the fixing nip N. A back side of the heater 22 defines a side that faces the heater holder 23.

As illustrated in FIG. 5, the heater 22 is constructed of a plurality of layers, that is, the base layer 50, the conductor layer 51, and the insulating layer 52. The base layer 50 is platy. The conductor layer 51 is mounted on the front side of the base layer 50. The insulating layer 52 coats the front side of the conductor layer 51. The conductor layer 51 includes the heat generator 60, a plurality of electrodes 61, and a plurality of feeders 62. The heat generator 60 includes a plurality of heat generating portions, that is, a center heat generating portion 60A and lateral end heat generating portions 60B. Each of the center heat generating portion 60A and the lateral end heat generating portions 60B includes a laminated, resistive heat generator. The electrodes 61 are disposed on both lateral ends of the base layer 50, respectively, in a longitudinal direction thereof. Each of the feeders 62 connects the electrode 61 to the heat generator 60. As illustrated in FIG. 4, at least a part of each of the electrodes 61 is not coated with the insulating layer 52 and is exposed so that the electrodes 61 are connected to a connector described below.

The base layer 50 is made of an insulating material, for example, ceramic such as alumina and aluminum nitride, glass, or the like. Alternatively, the base layer 50 may be made of metal such as stainless steel (e.g., SUS stainless steel), iron, copper, and aluminum. A separate insulating layer may be interposed between the base layer 50 and the conductor layer 51 to ensure insulation. Since metal has an enhanced durability against rapid heating and is processed readily, metal is preferably used to reduce manufacturing costs. Among metals, aluminum and copper are preferable because aluminum and copper attain an increased thermal conductivity and barely suffer from uneven temperature. Stainless steel is advantageous because stainless steel is manufactured at reduced costs compared to aluminum and copper.

The insulating layer 52 is made of heat resistant glass. Alternatively, the insulating layer 52 may be made of ceramic, PI, or the like.

For example, the heat generator 60 is produced as below. Silver-palladium (AgPd), glass powder, and the like are mixed into paste. The paste coats the base layer 50 by screen printing or the like. Thereafter, the base layer 50 is subject to firing. Alternatively, the heat generator 60 may be made of a resistive material such as a silver alloy (AgPt) and ruthenium oxide ($RuO_2$).

The feeders 62 are made of a conductor having a resistance value smaller than a resistance value of the heat generator 60. The feeders 62 and the electrodes 61 are made of a material prepared with silver (Ag), silver-palladium (AgPd), or the like by screen printing or the like.

According to the embodiments, the heat generator 60, the electrodes 61, and the feeders 62 are made of an alloy of silver, palladium, or the like to attain a positive temperature coefficient (PTC) property, that is, a property of temperature coefficient of resistance. The PTC property defines a property in which the resistance value increases as the temperature increases, for example, a heater output decreases under a given voltage. The heat generator 60 having the PTC property starts quickly with an increased output at low temperatures and suppresses overheating with a decreased output at high temperatures. For example, if a temperature coefficient of resistance (TCR) of the PTC property is in a range of from about 300 ppm/° C. to about 4,000 ppm/° C., the heater 22 is manufactured at reduced costs while retaining a resistance value needed for the heater 22. The TCR is preferably in a range of from about 500 ppm/° C. to about 2,000 ppm/° C. The TCR is calculated by measuring the resistance value at 25 degrees Celsius and 125 degrees Celsius. For example, if the temperature increases by 100 degrees Celsius and the resistance value increases by 10%, the TCR is 1,000 ppm/° C.

According to this embodiment, the heat generator 60 includes three heat generating portions arranged in the longitudinal direction of the base layer 50. One of the three heat generating portions is the center heat generating portion 60A serving as a primary heat generator disposed at a center of the base layer 50 in the longitudinal direction thereof. Remaining two of the three heat generating portions are the lateral end heat generating portions 60B serving as secondary heat generators that sandwich the center heat generating portion 60A in the longitudinal direction of the base layer 50. A controller (e.g., an external device 80 described below with reference to FIG. 21) controls the center heat generating portion 60A and the lateral end heat generating portions 60B to generate heat separately from each other.

As illustrated in FIG. 4, the plurality of electrodes 61 includes a first electrode 61A, a second electrode 61B, a third electrode 61C, and a fourth electrode 61D, which are arranged in this order from left to right in FIG. 4. When the second electrode 61B and the fourth electrode 61D are applied with a voltage, the center heat generating portion 60A generates heat. When the first electrode 61A and the second electrode 61B are applied with a voltage, the left, lateral end heat generating portion 60B in FIG. 4 generates heat. When the second electrode 61B and the third electrode 61C are applied with a voltage, the right, lateral end heat generating portion 60B in FIG. 4 generates heat. If the first electrode 61A and the third electrode 61C are connected in parallel in an outside of the heater 22 and configured to be applied with a voltage simultaneously, when the first electrode 61A, the third electrode 61C, and the second electrode 61B are applied with a voltage, both the lateral end heat generating portions 60B generate heat simultaneously. Arrows in FIG. 4 indicate directions in which an electric current flows in longitudinal directions of the center heat generating portion 60A and the lateral end heat generating portions 60B, respectively.

If a width of a sheet P conveyed through the fixing device 9 is equivalent to a width span L1 of the center heat generating portion 60A or smaller in the longitudinal direction of the heater 22, the center heat generating portion 60A generates heat. If a width of a sheet P conveyed through the fixing device 9 is greater than the width span L1 of the center heat generating portion 60A in the longitudinal direction of the heater 22, the center heat generating portion 60A and the lateral end heat generating portions 60B generate heat. Thus, the heater 22 changes a heat generating span in the longitudinal direction thereof according to a conveyance span where the sheet P is conveyed, that is, a width of the sheet P. The width span L1 of the center heat generating portion 60A is equivalent to a width of a small sheet P, for example, a width of 215 mm of an A4 size sheet in portrait orientation.

A width span L2 of a heat generating span defines a combined width of a width of one lateral end heat generating portion 60B, a width of the center heat generating portion 60A, and a width of another lateral end heat generating portion 60B in the longitudinal direction of the heater 22. The width span L2 is equivalent to a width of a large sheet P, for example, a width of 301 mm of an A3 size sheet in portrait orientation. Accordingly, when the small sheet P or the large sheet P is conveyed, the heater 22 barely suffers from overheating in a non-conveyance span where the small sheet P or the large sheet P is not conveyed. That is, the non-conveyance span is barely produced on the center heat generating portion 60A and the lateral end heat generating portions 60B. Consequently, the heater 22 improves productivity in printing.

As illustrated in FIG. 4, according to this embodiment, each of the center heat generating portion 60A and the lateral end heat generating portions 60B includes slopes 601 disposed at both lateral ends thereof, respectively. The slopes 601 are inclined relative to a sheet conveyance direction, that is, a vertical direction in FIG. 4, in which the sheet P is conveyed. At least a part of one of the slopes 601 overlaps at least a part of an adjacent one of the slopes 601 in the longitudinal direction of the heater 22, that is, a horizontal direction in FIG. 4. For example, as illustrated in an enlarged view in FIG. 4, the part of one of the slopes 601 and the part of the adjacent one of the slopes 601 are disposed in an identical overlap span A in the longitudinal direction of the heater 22. Accordingly, the slopes 601 that overlap each other suppress temperature decrease in a gap between the center heat generating portion 60A and each of the lateral end heat generating portions 60B and thereby decrease variation in fixing the toner image on the sheet P in a width direction thereof.

Figure 6:
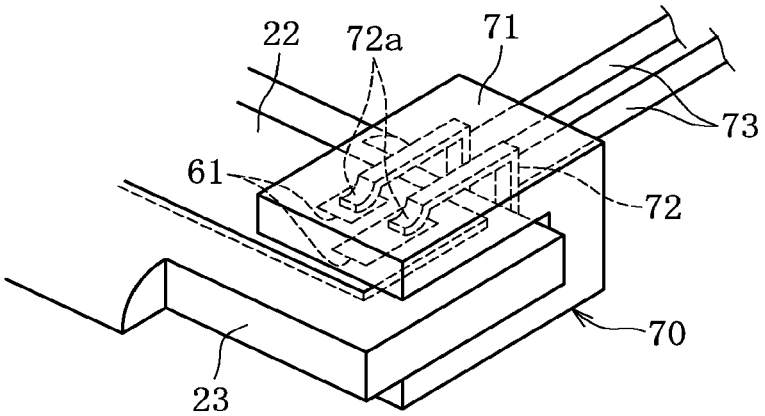
FIG. 6 is a perspective view of the heater and a heater holder incorporated in the fixing device depicted in FIG. 2, illustrating a connector attached to the heater and the heater holder.

FIG. 6 is a perspective view of the heater 22 and the heater holder 23, illustrating a connector 70 attached thereto.

As illustrated in FIG. 6, the connector 70 includes a housing 71 made of resin and a contact terminal 72 anchored to the housing 71. The contact terminal 72 is a flat spring. The contact terminal 72 includes a pair of contacts 72*a* that contacts the electrodes 61 of the heater 22, respectively. The contact terminal 72 of the connector 70 is coupled to a wire 73 (e.g., a harness) that supplies power.

As illustrated in FIG. 6, the connector 70 is attached to the heater 22 and the heater holder 23 such that the connector 70 sandwiches the heater 22 and the heater holder 23 together at the front side and the back side, respectively. Accordingly, each of the contacts 72*a* of the contact terminal 72 resiliently contacts or presses against the electrode 61 of the heater 22. Consequently, the heat generator 60 is electrically connected to a power supply disposed in the image forming apparatus 100 through the connector 70, allowing the power supply to supply power to the heat generator 60. Although FIG. 6 illustrates the connector 70 attached to one lateral end of the heater 22 in the longitudinal direction thereof, another connector 70 is similarly attached to another lateral end of the heater 22 in the longitudinal direction thereof.

Figure 7:
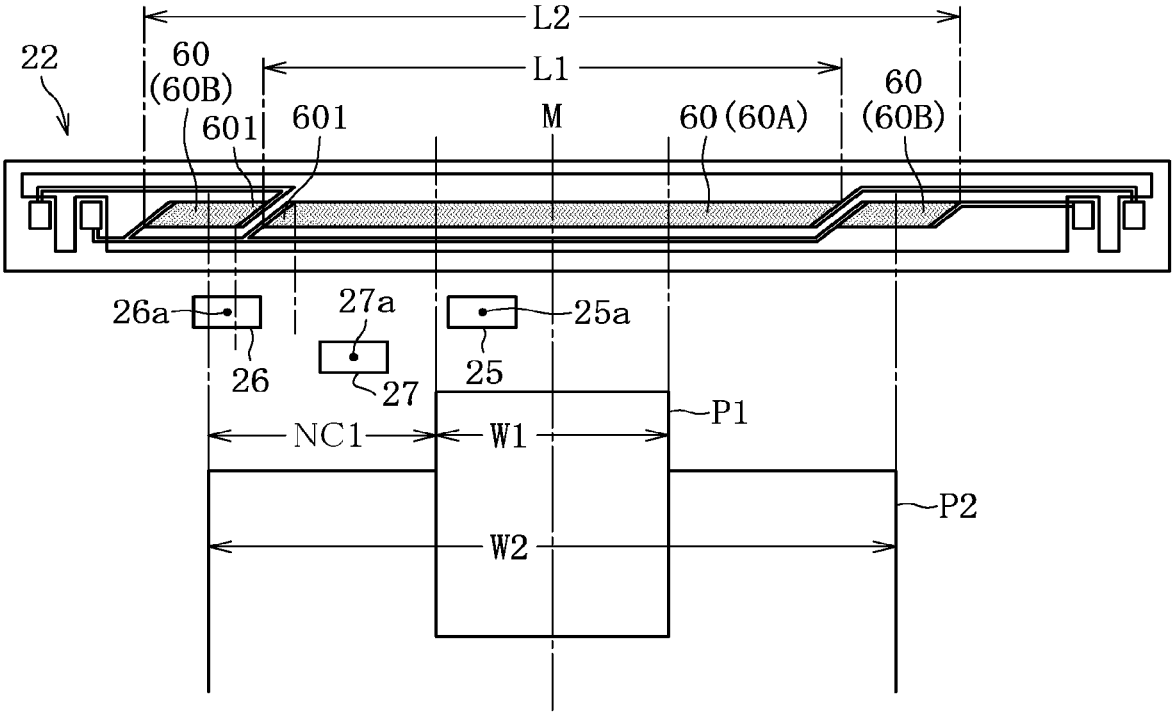
FIG. 7 is a diagram illustrating a positional relation between thermistors, a heat generator, and conveyance spans of the fixing device depicted in FIG. 2.

FIG. 7 is a diagram illustrating a positional relation between thermistors (e.g., the first thermistor 25, the second thermistor 26, and the third thermistor 27), the heat generator 60 (e.g., the center heat generating portion 60A and the lateral end heat generating portions 60B), and conveyance spans W1 and W2.

In FIG. 7, the conveyance span W1 defines a conveyance span in the longitudinal direction of the heater 22, where a small sheet P1 is conveyed through the fixing nip N. The small sheet P1 has a width smaller than the width span L1 of the center heat generating portion 60A in the longitudinal direction thereof. The conveyance span W2 defines a conveyance span in the longitudinal direction of the heater 22, where a large sheet P2 is conveyed through the fixing nip N.

The large sheet P2 has a width greater than the width span L1 of the center heat generating portion 60A in the longitudinal direction thereof.

The first thermistor 25 includes a temperature detecting portion 25*a* disposed within the width span L1 of the center heat generating portion 60A and the conveyance span W1 where the small sheet P1 is conveyed. Since the temperature detecting portion 25*a* of the first thermistor 25 is disposed within the width span L1 of the center heat generating portion 60A and the conveyance span W1 of the small sheet P1, when the small sheet P1 and sheets P having widths greater than the width of the small sheet P1 are conveyed, the first thermistor 25 detects the temperature of the center heat generating portion 60A in a conveyance span where the small sheet P1 and the sheets P greater than the small sheet P1 are conveyed. If a plurality of sizes of sheets P that have widths smaller than the width span L1 of the center heat generating portion 60A is available for the fixing device 9, the temperature detecting portion 25*a* of the first thermistor 25 is disposed within a conveyance span of a sheet P having a minimum width of the widths of the sheets P having the plurality of sizes, respectively. Accordingly, the first thermistor 25 detects the temperature of the center heat generating portion 60A in conveyance spans of the sheets P of the plurality of sizes as the sheets P are conveyed over the center heat generating portion 60A.

The second thermistor 26 includes a temperature detecting portion 26*a* disposed outboard from the width span L1 of the center heat generating portion 60A in the longitudinal direction thereof and within the conveyance span W2 where the large sheet P2 is conveyed. For example, the temperature detecting portion 26*a* of the second thermistor 26 is disposed within the conveyance span W2 where the large sheet P2 is conveyed over the lateral end heat generating portions 60B. Since the temperature detecting portion 26*a* of the second thermistor 26 is disposed outboard from the width span L1 of the center heat generating portion 60A and within the conveyance span W2 where the large sheet P2 is conveyed, when the large sheet P2 is conveyed, the second thermistor 26 detects the temperature of the lateral end heat generating portion 60B in the conveyance span W2 where the large sheet P2 is conveyed. If a plurality of sizes of sheets P that are conveyed over the lateral end heat generating portions 60B is available for the fixing device 9, the temperature detecting portion 26*a* of the second thermistor 26 is disposed within a conveyance span of a sheet P having a minimum width of widths of the sheets P having the plurality of sizes, respectively. Accordingly, the second thermistor 26 detects the temperature of the lateral end heat generating portion 60B in conveyance spans of the sheets P of the plurality of sizes as the sheets P are conveyed over the lateral end heat generating portions 60B.

The third thermistor 27 includes a temperature detecting portion 27*a* disposed outboard from the conveyance span W1 of the small sheet P1 in the longitudinal direction of the heater 22 and within the width span L1 of the center heat generating portion 60A. For example, the temperature detecting portion 27*a* of the third thermistor 27 is disposed in a non-conveyance span (e.g., a non-passage span) where the small sheet P1 is not conveyed over the center heat generating portion 60A. Since the temperature detecting portion 27*a* of the third thermistor 27 is disposed outboard from the conveyance span W1 of the small sheet P1 in the longitudinal direction of the heater 22 and within the width span L1 of the center heat generating portion 60A, when the small sheet P1 is conveyed, the third thermistor 27 detects the temperature of the fixing belt 20 in a non-conveyance span NC1 of the center heat generating portion 60A where the small sheet P1 is not conveyed.

Information about temperatures detected by the first thermistor 25, the second thermistor 26, and the third thermistor 27 is sent to the controller (e.g., the external device 80) that controls heat generation of the center heat generating portion 60A and the lateral end heat generating portions 60B. The controller controls the center heat generating portion 60A and the lateral end heat generating portions 60B separately based on the information sent to the controller. Thus, the controller controls the center heat generating portion 60A and the lateral end heat generating portions 60B to generate heat to heat the fixing belt 20 to a predetermined target temperature (e.g., a fixing temperature) at the fixing nip N.

However, when heat generated by the heater 22 is barely consumed in the non-conveyance span NC1, for example, when a plurality of small sheets P1 is conveyed continuously, the temperature of the fixing belt 20 in the non-conveyance span NC1 may increase excessively. In this case, the third thermistor 27 detects that the temperature of the fixing belt 20 in the non-conveyance span NC1 is a predetermined temperature or higher, so that the controller controls the heater 22 to generate heat in a decreased amount. Additionally, temperature increase (e.g., overheating) in the non-conveyance span NC1 is suppressed by decreasing a conveyance speed at which the sheets P are conveyed, increasing an interval with which the sheets P are conveyed, or interrupting image formation.

According to this embodiment, the slopes 601 are disposed at both lateral ends of each of the center heat generating portion 60A and the lateral end heat generating portions 60B, respectively, in the longitudinal direction of the heater 22. The slopes 601 may be susceptible to a decreased amount of heat generation compared to other portion (e.g., a center portion in the longitudinal direction) of each of the center heat generating portion 60A and the lateral end heat generating portions 60B. Hence, if the temperature detecting portions 26*a* and 27*a* of the second thermistor 26 and the third thermistor 27, respectively, are disposed opposite the slopes 601, the temperature detecting portions 26*a* and 27*a* may detect the temperature of the lateral end heat generating portion 60B and the fixing belt 20 heated by the center heat generating portion 60A with a degraded accuracy.

To address this circumstance, as illustrated in FIG. 7, the temperature detecting portions 26*a* and 27*a* of the second thermistor 26 and the third thermistor 27, respectively, are preferably disposed opposite portions of the lateral end heat generating portion 60B and the center heat generating portion 60A other than the slopes 601, for example, the center portions of the lateral end heat generating portion 60B and the center heat generating portion 60A in the longitudinal direction thereof, respectively. Accordingly, the second thermistor 26 and the third thermistor 27 detect the temperature of the lateral end heat generating portion 60B and the fixing belt 20 heated by the center heat generating portion 60A, respectively, with an improved accuracy.

According to this embodiment, the second thermistor 26 is disposed opposite one of the lateral end heat generating portions 60B. Alternatively, another second thermistor 26 may also be disposed opposite another one of the lateral end heat generating portions 60B. However, according to this embodiment, the image forming apparatus 100 employs a center conveyance method in which the small sheet P1 and the large sheet P2 of difference sizes are conveyed in a state in which the small sheet P1 and the large sheet P2 are centered at a center position M in the longitudinal direction of the heater 22, that is, a width direction of the small sheet P1 and the large sheet P2. In this case, a temperature distribution of the fixing belt 20 is basically symmetric with respect to the center position M of the small sheet P1 and the large sheet P2 in the width direction thereof. Accordingly, if the second thermistor 26 is disposed opposite one of the lateral end heat generating portions 60B, the controller also controls another one of the lateral end heat generating portions 60B similarly.

The first thermistor 25 and the second thermistor 26 serve as conveyance span sensors or conveyance span temperature detectors disposed in the conveyance spans W1 and W2, respectively. The first thermistor 25 and the second thermistor 26 preferably detect temperature change at the fixing nip N quickly and precisely so that the controller controls the temperature of the center heat generating portion 60A and the lateral end heat generating portions 60B in the conveyance spans W1 and W2 appropriately. To address this circumstance, as illustrated in FIG. 2, the first thermistor 25 and the second thermistor 26 contact a back face of the heater 22, that is opposite a front face of the heater 22, that faces the fixing nip N. Since the first thermistor 25 and the second thermistor 26 contact the back face of the heater 22, the first thermistor 25 and the second thermistor 26 directly detect the temperature of the heater 22 serving as a heat generating source disposed in proximity to the fixing nip N. Accordingly, the controller controls the temperature of the center heat generating portion 60A and the lateral end heat generating portions 60B in the conveyance spans W1 and W2 appropriately based on detection results provided by the first thermistor 25 and the second thermistor 26, respectively.

Conversely, the third thermistor 27 serves as a non-conveyance span sensor or a non-conveyance span temperature detector disposed in the non-conveyance span NC1 where the small sheet P1 is not conveyed. As illustrated in FIG. 2, in order to detect the temperature of the lubricant precisely, the third thermistor 27 is disposed opposite the outer circumferential surface of the fixing belt 20. The temperature of the lubricant is closer to the temperature of the fixing belt 20 than the temperature of the heater 22. Hence, as the third thermistor 27 detects the temperature of the outer circumferential surface of the fixing belt 20, the third thermistor 27 detects the temperature of the lubricant precisely. Accordingly, if the fixing belt 20 suffers from overheating in the non-conveyance span NC1, for example, if the temperature of the fixing belt 20 exceeds 220 degrees Celsius, the fixing device 9 performs controls to suppress temperature increase of the non-conveyance span NC1 by decreasing a heat generation amount of the heater 22 and decreasing productivity in printing, for example, based on a detection result provided by the third thermistor 27. Consequently, the fixing device 9 suppresses thermal degradation of the lubricant precisely and retains performance of the lubricant properly for an extended period of time.

The third thermistor 27 is disposed in proximity to the fixing belt 20 and disposed away from the heater 22 serving as a heat generating source. Hence, the third thermistor 27 is less susceptible to temperature increase compared to the first thermistor 25 and the second thermistor 26. Accordingly, the third thermistor 27 suppresses thermal degradation and breakage. Additionally, since the third thermistor 27 is barely susceptible to heat from the heater 22, a thermistor that has a decreased heat resistance and is manufactured at reduced costs is used as the third thermistor 27 compared to the first thermistor 25 and the second thermistor 26.

Figure 8:
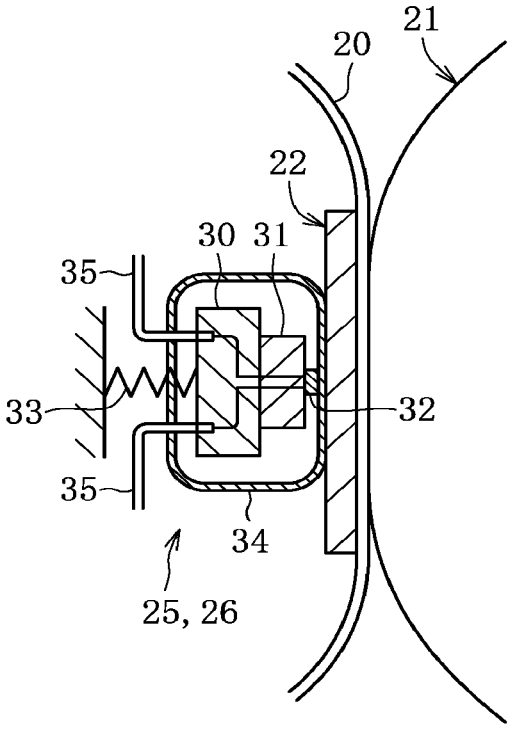
FIG. 8 is a cross-sectional view of a first thermistor and a second thermistor incorporated in the fixing device depicted in FIG. 2.
Figure 9:
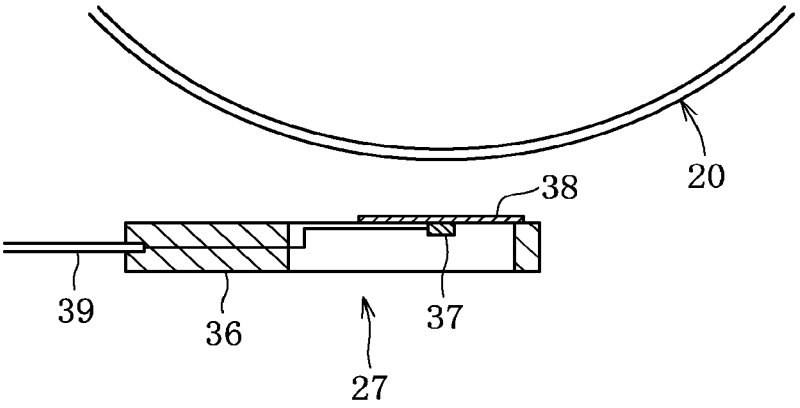
FIG. 9 is a cross-sectional view of a third thermistor incorporated in the fixing device depicted in FIG. 2.

FIG. 8 illustrates one example of a construction of the first thermistor 25 and the second thermistor 26. FIG. 9 illustrates one example of a construction of the third thermistor 27.

As illustrated in FIG. 8, each of the first thermistor 25 and the second thermistor 26 includes a holder 30, an elastic member 31, a temperature detecting element 32 as the temperature detecting portions 25*a* and 26*a*, a spring 33 serving as a biasing member, and an insulating sheet 34. The holder 30 is made of resin such as LCP. The temperature detecting element 32 is mounted on a heater side face of the holder 30, that faces the heater 22, via the elastic member 31. The elastic member 31 is made of a material that has a thermal conductivity and a rigidity that are smaller than a thermal conductivity and a rigidity of the holder 30. The elastic member 31 has elasticity and thermal insulation. The insulating sheet 34 is made of an insulating material such as PI and covers the holder 30, the elastic member 31, and the temperature detecting element 32. The spring 33 biases the holder 30 against the heater 22, pressing the temperature detecting element 32 against the heater 22 via the insulating sheet 34. Two wires 35 (e.g., lead wires) are extended from the holder 30 and connected to the temperature detecting element 32. Each of the wires 35 is coated with an insulating film. The insulating film coating each of the wires 35 preferably has a thickness of 0.4 mm or greater, for example, in view of heat resistance. If the insulating film has a thickness of 0.4 mm or smaller, a plurality of films may be layered on the wire 35.

On the other hand, as illustrated in FIG. 9, the third thermistor 27 includes a holder 36, a temperature detecting element 37 as the temperature detecting portion 27*a*, and an insulating sheet 38. The temperature detecting element 37 is disposed in the holder 36 and is disposed opposite the outer circumferential surface of the fixing belt 20 via the insulating sheet 38. Two wires 39 (e.g., lead wires) are extended from the holder 36 and connected to the temperature detecting element 37. Each of the wires 39 is coated with an insulating film.

Since the third thermistor 27 is allowed to have a heat resistance smaller than a heat resistance of the first thermistor 25 and the second thermistor 26, the third thermistor 27 does not incorporate an elastic member that achieves thermal insulation. Additionally, since the third thermistor 27 is allowed to have a decreased heat resistance, the holder 36 may be made of a material having a heat resistance smaller than a heat resistance of the holder 30 of each of the first thermistor 25 and the second thermistor 26. Further, the insulating film coating the wire 39 of the third thermistor 27 may also be made of a material having a heat resistance smaller than a heat resistance of the insulating film coating the wire 35 of each of the first thermistor 25 and the second thermistor 26. The insulating film coating the wire 39 of the third thermistor 27 may have a thickness smaller than a thickness of the insulating film coating the wire 35 of each of the first thermistor 25 and the second thermistor 26. The number of the insulating films coating the wire 39 may be smaller than the number of the insulating films coating the wire 35. According to an example of the third thermistor 27 illustrated in FIG. 9, the third thermistor 27 is a non-contact type thermistor that detects the temperature of the fixing belt 20 without contacting the fixing belt 20. Accordingly, unlike the first thermistor 25 and the second thermistor 26, the third thermistor 27 does not incorporate the biasing member (e.g., the spring 33), reducing manufacturing costs.

According to the embodiments described above, a contact type thermistor that contacts the heater 22 is used as the first thermistor 25 and the second thermistor 26. Alternatively, a non-contact type thermistor that detects the temperature of the heater 22 without contacting the heater 22 may be employed. Yet alternatively, the first thermistor 25 and the second thermistor 26 may be disposed opposite the heater 22 indirectly via an element. For example, the back face of the heater 22, that faces the heater holder 23, mounts a thermal insulator having a thermal conductivity smaller than a thermal conductivity of the heater holder 23. The first thermistor 25 and the second thermistor 26 may be disposed opposite the heater 22 via the thermal insulator. The thermal insulator suppresses unnecessary heat conduction from the heater 22 to the heater holder 23, causing the heater 22 to heat the fixing belt 20 effectively and saving energy.

Conversely, the back face of the heater 22 may mount an enhanced thermal conductor having a thermal conductivity greater than a thermal conductivity of the base layer 50 of the heater 22 so that the first thermistor 25 and the second thermistor 26 are disposed opposite the heater 22 via the enhanced thermal conductor. The enhanced thermal conductor suppresses uneven temperature of the heater 22 in the longitudinal direction and a short direction of the heater 22. For example, the enhanced thermal conductor suppresses uneven temperature of the heater 22 in the longitudinal direction thereof, reducing temperature increase in the non-conveyance span NC1 when the small sheet P1 is conveyed and improving productivity in printing on the small sheet P1. Additionally, the enhanced thermal conductor suppresses uneven temperature of the heater 22 in the short direction thereof, decreasing a peak value of temperature increase of the back face of the heater 22. That is, a thermistor that has a decreased heat resistance and is manufactured at reduced costs is used as each of the first thermistor 25 and the second thermistor 26.

In a configuration in which the first thermistor 25 and the second thermistor 26 are not in contact with the heater 22 or are disposed opposite the heater 22 indirectly via the element, the lubricant is more subject to thermal degradation compared to a configuration in which the first thermistor 25 and the second thermistor 26 contact the heater 22 directly because a difference is substantial between a temperature of the heater 22, that is detected by each of the first thermistor 25 and the second thermistor 26, and a temperature of the fixing belt 20. To address this circumstance, according to this embodiment, the third thermistor 27 detects the temperature of the fixing belt 20 in the non-conveyance span NC1, suppressing degradation of the lubricant precisely.

According to this embodiment, as illustrated in FIG. 2, the third thermistor 27 is disposed opposite the outer circumferential surface of the fixing belt 20 without contacting the outer circumferential surface of the fixing belt 20. Additionally, the third thermistor 27 is disposed opposite the outer circumferential surface of the fixing belt 20 and is disposed upstream from the fixing nip N in a rotation direction of the fixing belt 20 at an entry to the fixing nip N.

Figure 10:
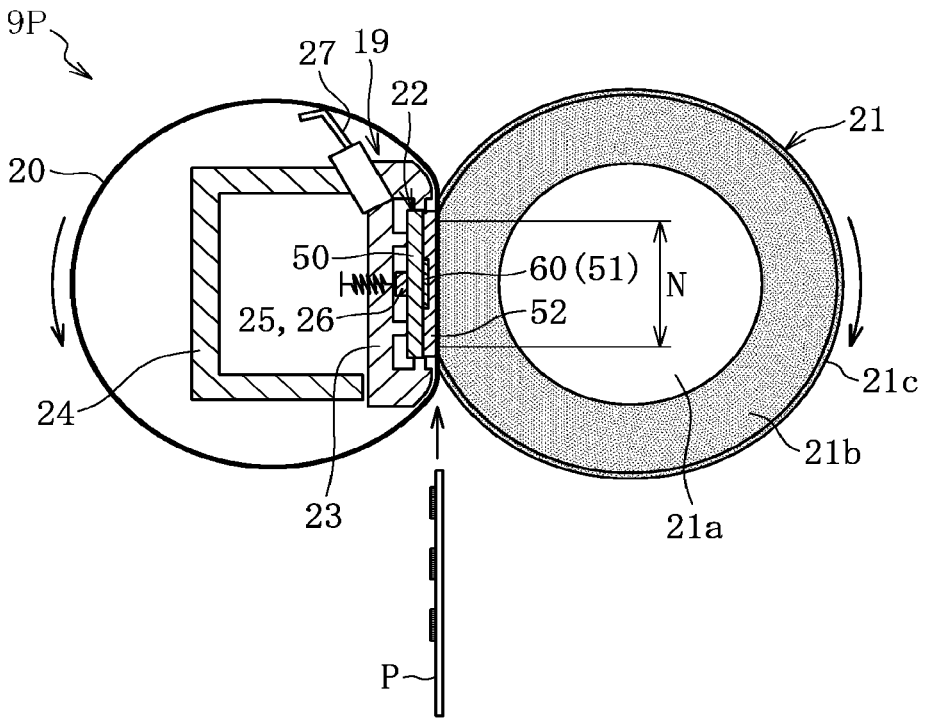
FIG. 10 is a cross-sectional view of a fixing device installable in the image forming apparatus depicted in FIG. 1, illustrating the third thermistor that contacts an inner circumferential surface of the fixing belt directly.

Conversely, as illustrated in FIG. 10, the third thermistor 27 may contact the inner circumferential surface of the fixing belt 20 directly without an element other than the lubricant that is interposed between the third thermistor 27 and the fixing belt 20. FIG. 10 is a schematic cross-sectional view of a fixing device 9P incorporating the third thermistor 27 contacting the inner circumferential surface of the fixing belt 20. Additionally, the third thermistor 27 may be disposed downstream from the fixing nip N in the rotation direction of the fixing belt 20 at an exit of the fixing nip N.

Figure 11:
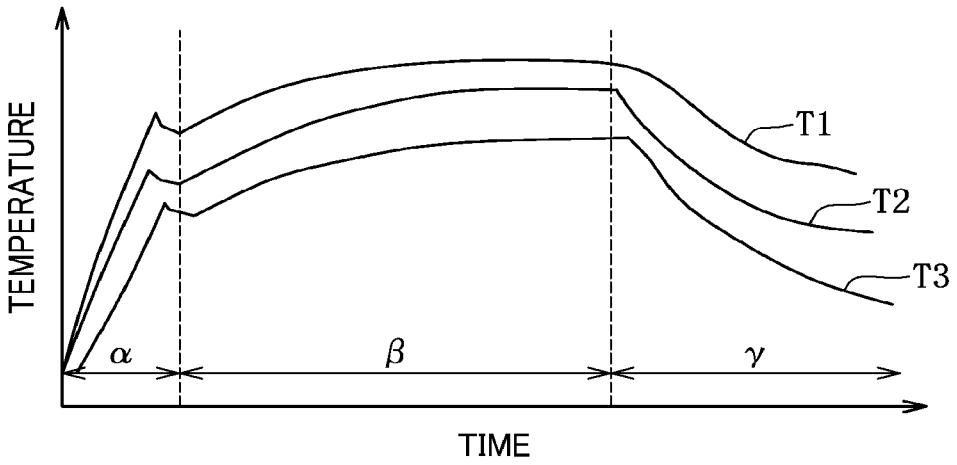
FIG. 11 is a graph illustrating results of a test that measures temperatures of a back face of the heater, the inner circumferential surface of the fixing belt, and an outer circumferential surface of the fixing belt, respectively, that is incorporated in the fixing device depicted in FIG. 2.

Referring to FIG. 11, a description is provided of a relation between the position of the third thermistor 27 and the temperature of the heater 22 and the fixing belt 20, that is detected by the third thermistor 27.

In FIG. 11, a temperature T1 represents the temperature of the back face of the heater 22, that is detected by the third thermistor 27 disposed at a first position where the third thermistor 27 contacts the back face of the heater 22. A temperature T2 represents the temperature of the inner circumferential surface of the fixing belt 20, that is detected by the third thermistor 27 disposed at a second position illustrated in FIG. 10. A temperature T3 represents the temperature of the outer circumferential surface of the fixing belt 20, that is detected by the third thermistor 27 disposed at a third position illustrated in FIG. 2. The first position, the second position, and the third position of the third thermistor 27 are identical in the longitudinal direction of the heater 22. For example, the first position, the second position, and the third position of the third thermistor 27 are outboard from the conveyance span W1 of the small sheet P1 and within the width span L1 of the center heat generating portion 60A in the longitudinal direction of the heater 22, as illustrated in FIG. 7.

In a test in which the third thermistor 27 detected the temperature of the heater 22 and the fixing belt 20 at the first position, the second position, and the third position, a peak value of the temperature of the heater 22, that was detected by the first thermistor 25 disposed opposite a center span of the heater 22 in the longitudinal direction thereof, was controlled to be 200 degrees Celsius. 30 sheets (e.g., plain paper) of A6 size in portrait orientation were conveyed per minute and were fixed with toner images, respectively. In FIG. 11, a time period $\alpha$ represents a startup time from starting of heating by the heater 22 until starting of conveyance of a sheet. A time period $\beta$ represents a conveyance time when the sheet is conveyed. A time period $\gamma$ represents a post conveyance time after conveyance of the sheet finishes and heat generation of the heater 22 is interrupted.

As illustrated in FIG. 11, the temperature T1 of the back face of the heater 22 was overall higher than the temperature T2 of the inner circumferential surface of the fixing belt 20 and the temperature T3 of the outer circumferential surface of the fixing belt 20. Rotation of the fixing belt 20 accelerated radiation of heat from the fixing belt 20 into air. Conversely, the heater 22 that did not rotate did not accelerate radiation of heat from the heater 22, retaining the higher temperature T1. While the sheet was conveyed, the temperature T1 of the back face of the heater 22 was saturated when an approximately half of the time period $\beta$, that is, the conveyance time, elapsed.

Conversely, the temperature T2 of the inner circumferential surface of the fixing belt 20 and the temperature T3 of the outer circumferential surface of the fixing belt 20 increased gradually even after the temperature T1 of the back face of the heater 22 was saturated. Since a thermal capacity of the fixing belt 20 was greater than a thermal capacity of the heater 22, it took a longer time before the temperatures T2 and T3 were saturated.

After conveyance of the sheet finished, the temperatures T1, T2, and T3 decreased gradually as time elapsed. However, the temperature T1 of the back face of the heater 22 decreased slowly compared to the temperature T2 of the inner circumferential surface of the fixing belt 20 and the temperature T3 of the outer circumferential surface of the fixing belt 20. That is, a gradient of the temperature T1 was gentler than a gradient of each of the temperatures T2 and T3. The heater 22 was disposed opposite the pressure roller 21 having an increased thermal capacity via the fixing belt 20. Accordingly, heat stored in the pressure roller 21 slowed decrease in the temperature T1 of the back face of the heater 22.

Conversely, the third thermistor 27, that was disposed at the second position to detect the temperature T2 of the inner circumferential surface of the fixing belt 20 or the third position to detect the temperature T3 of the outer circumferential surface of the fixing belt 20, was not disposed opposite an opposed member that stored heat such as the pressure roller 21. Hence, the temperatures T2 and T3 decreased quickly compared to the temperature T1 of the back face of the heater 22.

Thus, the temperature T1 of the back face of the heater 22 was different from the temperature T2 of the inner circumferential surface of the fixing belt 20 and the temperature T3 of the outer circumferential surface of the fixing belt 20 due to the time taken until temperature saturation during conveyance of the sheet and the temperature decreasing speed after conveyance of the sheet in addition to the absolute value of temperature. Accordingly, it is difficult to precisely estimate the temperature of the inner circumferential surface of the fixing belt 20, that is close to the temperature of the lubricant, solely based on the temperature of the heater 22, that is detected by a thermistor disposed opposite the back face of the heater 22. To address this circumstance, according to this embodiment, as illustrated in FIGS. 2 and 10, the third thermistor 27 detects the temperature of the fixing belt 20. Accordingly, the controller recognizes the temperature of the fixing belt 20, that is closer to the temperature of the lubricant, and change in the temperature of the fixing belt 20, thus suppressing thermal degradation of the lubricant precisely.

Conversely, the temperature T3 of the outer circumferential surface of the fixing belt 20 was overall lower than the temperature T2 of the inner circumferential surface of the fixing belt 20. It was because, in the fixing device 9 illustrated in FIG. 2, the third thermistor 27 did not contact the outer circumferential surface of the fixing belt 20 in addition to thermal resistance of the fixing belt 20 when heat was conducted from the inner circumferential surface of the fixing belt 20 to the outer circumferential surface of the fixing belt 20. The temperature of the fixing belt 20 increased at the exit of the fixing nip N immediately after the heater 22 heated the fixing belt 20. Thereafter, the temperature of the fixing belt 20 decreased as heat was radiated from a heated portion of the fixing belt 20 until the heated portion reached the entry to the fixing nip N while the fixing belt 20 rotated. Hence, the temperature T3 of the outer circumferential surface of the fixing belt 20, that was detected at the entry to the fixing nip N as illustrated in FIG. 2, was lower than the temperature T2 of the inner circumferential surface of the fixing belt 20, that was detected at the exit of the fixing nip N as illustrated in FIG. 10. Accordingly, the temperature T3 of the outer circumferential surface of the fixing belt 20 was overall lower than the temperature T2 of the inner circumferential surface of the fixing belt 20. The temperature T3 also tended to change somewhat slowly compared to the temperature T2.

In view of the above, in order to detect the temperature of the lubricant more precisely, the third thermistor 27 disposed opposite the inner circumferential surface of the fixing belt 20 as illustrated in FIG. 10 is more preferable compared to the third thermistor 27 disposed opposite the outer circumferential surface of the fixing belt 20 as illustrated in FIG. 2. For example, if the fixing belt 20 includes the base 20*c* and the elastic layer 20*d* mounted on an outer circumferential surface of the base 20*c*, the elastic layer 20*d* increases a temperature difference between the inner circumferential surface and the outer circumferential surface of the fixing belt 20. To address this circumstance, the third thermistor 27 detects the temperature of the inner circumferential surface of the fixing belt 20, thus detecting the temperature of the lubricant precisely. In order to detect temperature change of the lubricant more quickly, the third thermistor 27 contacting the fixing belt 20 directly as illustrated in FIG. 10 is more preferable compared to the third thermistor 27 disposed opposite the fixing belt 20 without contacting the fixing belt 20 as illustrated in FIG. 2. More preferably, the third thermistor 27 is disposed in proximity to the exit of the fixing nip N where the fixing belt 20 has a higher temperature so as to detect the temperature of the fixing belt 20 as illustrated in FIG. 10.

The position of the third thermistor 27 may be modified properly according to a relation between the third thermistor 27 and other elements of the fixing device 9, a layout of the elements of the fixing device 9, and the like. Thus, the position of the third thermistor 27 is determined based on a proper combination of whether the inner circumferential surface or the outer circumferential surface of the fixing belt 20, which of the entry to the fixing nip N, the exit of the fixing nip N, and other position, and whether contacting or not contacting the fixing belt 20.

Figure 12:
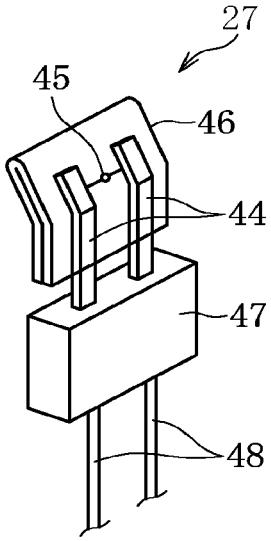
FIG. 12 is a perspective view of the third thermistor depicted in FIG. 10, as one example of a contact type thermistor.

The third thermistor 27 depicted in FIG. 10, that is, a contact type thermistor contacting the fixing belt 20, may employ a construction illustrated in FIG. 12, for example.

As illustrated in FIG. 12, the third thermistor 27 includes a pair of conductors 44, a temperature detecting element 45, an insulating sheet 46, a holder 47, and wires 48. The pair of conductors 44 is resilient. The temperature detecting element 45 is interposed between the conductors 44 and is electrically connected to the conductors 44. The insulating sheet 46 coats or covers the temperature detecting element 45 and the conductors 44. The holder 47 holds or supports the conductors 44. The wires 48 (e.g., lead wires) are electrically connected to the conductors 44, respectively, inside the holder 47. The temperature detecting element 45 and the conductors 44 are disposed opposite the inner circumferential surface of the fixing belt 21 via the insulating sheet 46. The holder 47 may have a shape that is positioned with respect to the heater holder 23 or the like described above. The holder 47 is preferably made of heat resistant resin such as LCP.

The insulating sheet 46 is preferably made of a material that is heat resistant and facilitates sliding, such as polyimide and PTFE. For example, if the lubricant contains a conductive material, when the lubricant adheres to the temperature detecting element 45 and the conductors 44, the temperature detecting element 45 and the conductors 44 may not retain insulation and may cause dielectric breakdown. To address this circumstance, the insulating sheet 46 preferably coats or covers the temperature detecting element 45 and each of the conductors 44. Even if the lubricant does not contain the conductive material, the inner circumferential surface of the fixing belt 20 and a belt side face of the heater 22, that contacts the fixing belt 20, may be made of a material containing the conductive material. In this case, while the fixing belt 20 slides over the heater 22, conductive abrasion powder may generate and may be mixed into the lubricant. To address this circumstance, in this case also, the insulating sheet 46 preferably coats or covers the temperature detecting element 45 and each of the conductors 44 similarly.

Figure 13:
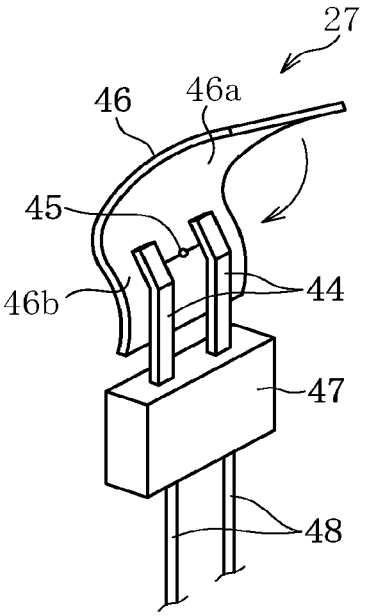
FIG. 13 is a perspective view of the third thermistor depicted in FIG. 12, illustrating a method for installing an insulating sheet.
Figure 14:
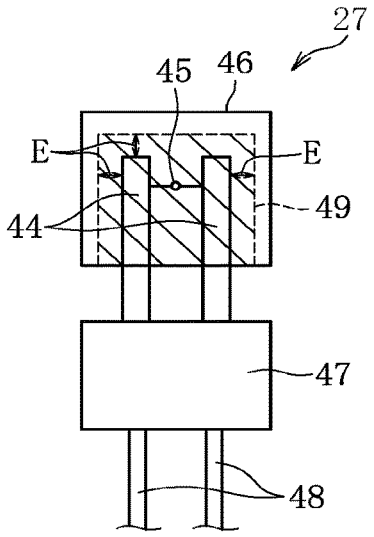
FIG. 14 is a cross-sectional view of the third thermistor depicted in FIG. 12, illustrating a periphery of an adhesion face of the insulating sheet.

For example, as illustrated in FIG. 13, the insulating sheet 46 is folded in half and attached to the temperature detecting element 45 and each of the conductors 44 such that the insulating sheet 46 sandwiches the temperature detecting element 45 and each of the conductors 44. In this case, a mating face 46*a* of the insulating sheet 46 preferably adheres to a mating face 46*b* of the insulating sheet 46 with a heat resistant adhesive to prevent the conductive lubricant and the conductive abrasion powder from entering a gap between the mating faces 46*a* and 46*b*. The mating face 46*a* adheres to the mating face 46*b* in a periphery of the temperature detecting element 45. As illustrated in FIG. 14, the insulating sheet 46 includes an adhesion face 49 indicated with hatching in FIG. 14. The adhesion face 49 preferably has a region that is greater than at least a circumference of the temperature detecting element 45 by 2 mm or greater and more preferably has a region that is greater than a circumference of each of the conductors 44 by 2 mm or greater. For example, a distance E is 2 mm or greater in FIG. 14.

Figure 15:
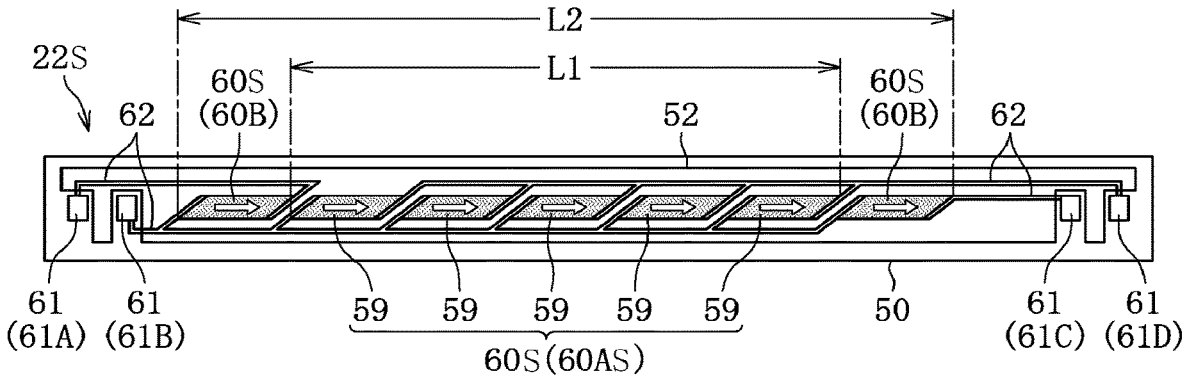
FIG. 15 is a plan view of a heater as a first variation of the heater depicted in FIG. 4.
Figure 16:
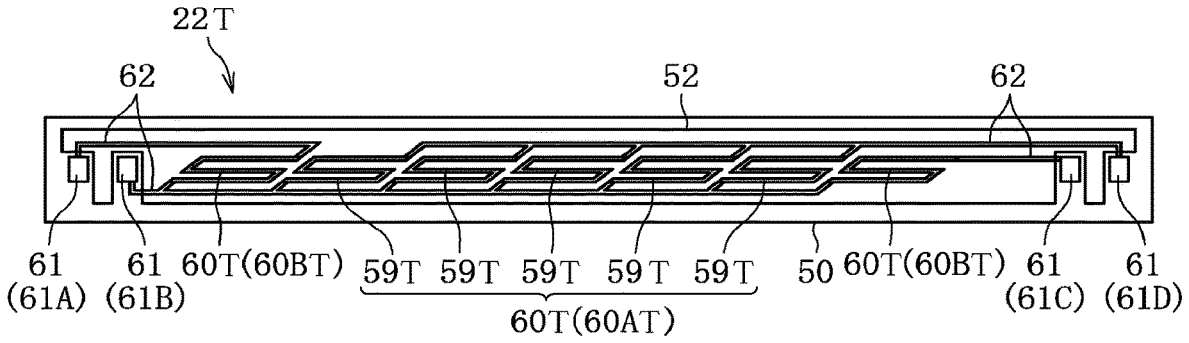
FIG. 16 is a plan view of a heater as a second variation of the heater depicted in FIG. 4.
Figure 17:
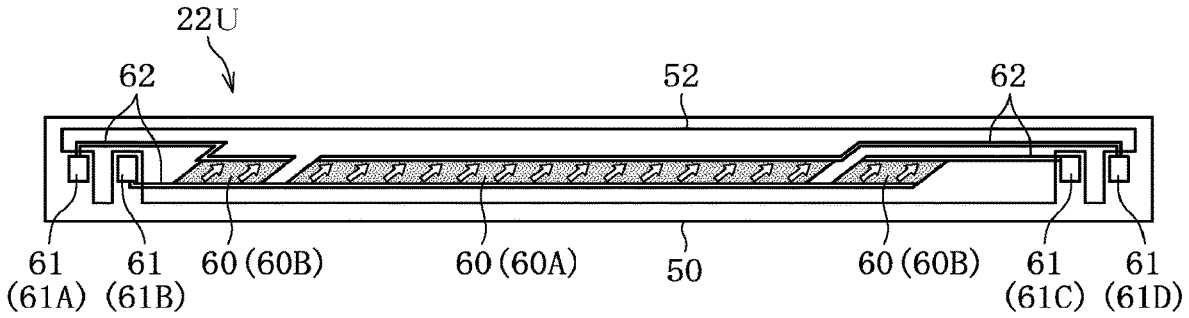
FIG. 17 is a plan view of a heater as a third variation of the heater depicted in FIG. 4.

Alternatively, the heater 22 according to the embodiments of the present disclosure may have constructions illustrated in FIGS. 15 to 17, respectively, other than the construction described above.

FIG. 15 illustrates a heater 22S as a first variation of the heater 22. The heater 22S includes a heat generator 60S incorporating a center heat generating portion 60AS which is divided into a plurality of heat generating blocks 59 in a longitudinal direction of the center heat generating portion 60AS. The center heat generating portion 60AS is not constructed of a single elongate heat generating block and is divided into the plurality of short heat generating blocks 59. Accordingly, a width of each of the heat generating blocks 59 is equivalent to a width of each of the lateral end heat generating portions 60B in a longitudinal direction of the heater 22S. A resistance value of each of the heat generating blocks 59 is equivalent to a resistance value of each of the lateral end heat generating portions 60B. For example, a width span L1 of the center heat generating portion 60AS is equivalent to a width of 215 mm of an A4 size sheet in portrait orientation. A width span L2 of a heat generating span defines a combined width of a width of one lateral end heat generating portion 60B, a width of the center heat generating portion 60AS, and a width of another lateral end heat generating portion 60B in the longitudinal direction of the heater 22S. The width span L2 is equivalent to a width of 301 mm of an A3 size sheet in portrait orientation. In this case, as the center heat generating portion 60AS is divided into the five heat generating blocks 59, each of the heat generating blocks 59 and the lateral end heat generating portions 60B has an identical width of 43 mm. Accordingly, the resistance value of each of the heat generating blocks 59 is equivalent to the resistance value of each of the lateral end heat generating portions 60B, thus heating the fixing belt 20 evenly in the width direction thereof.

FIG. 16 illustrates a heater 22T as a second variation of the heater 22. The heater 22T includes a heat generator 60T incorporating a center heat generating portion 60AT and lateral end heat generating portions 60BT. The center heat generating portion 60AT is divided into a plurality of heat generating blocks 59T in a longitudinal direction of the center heat generating portion 60AT. Each of the heat generating blocks 59T and the lateral end heat generating portions 60BT is bent to produce a turned pattern. An electric current flows along the turned pattern.

FIG. 17 illustrates a heater 22U as a third variation of the heater 22. Each of the center heat generating portion 60A and the lateral end heat generating portions 60B is coupled to the feeders 62 at each end of the center heat generating portion 60A and the lateral end heat generating portions 60B in a short direction thereof. In this case, as illustrated with arrows in FIG. 17, the electric current flows in diagonal directions defined by the longitudinal directions and the short directions of the center heat generating portion 60A and the lateral end heat generating portions 60B, respectively.

The following describes embodiments that are different from the embodiments described above.

The embodiments below are described mainly of configurations that are different from those of the embodiments described above. A description of other configurations that are basically common to the embodiments described above is omitted.

Figure 18:
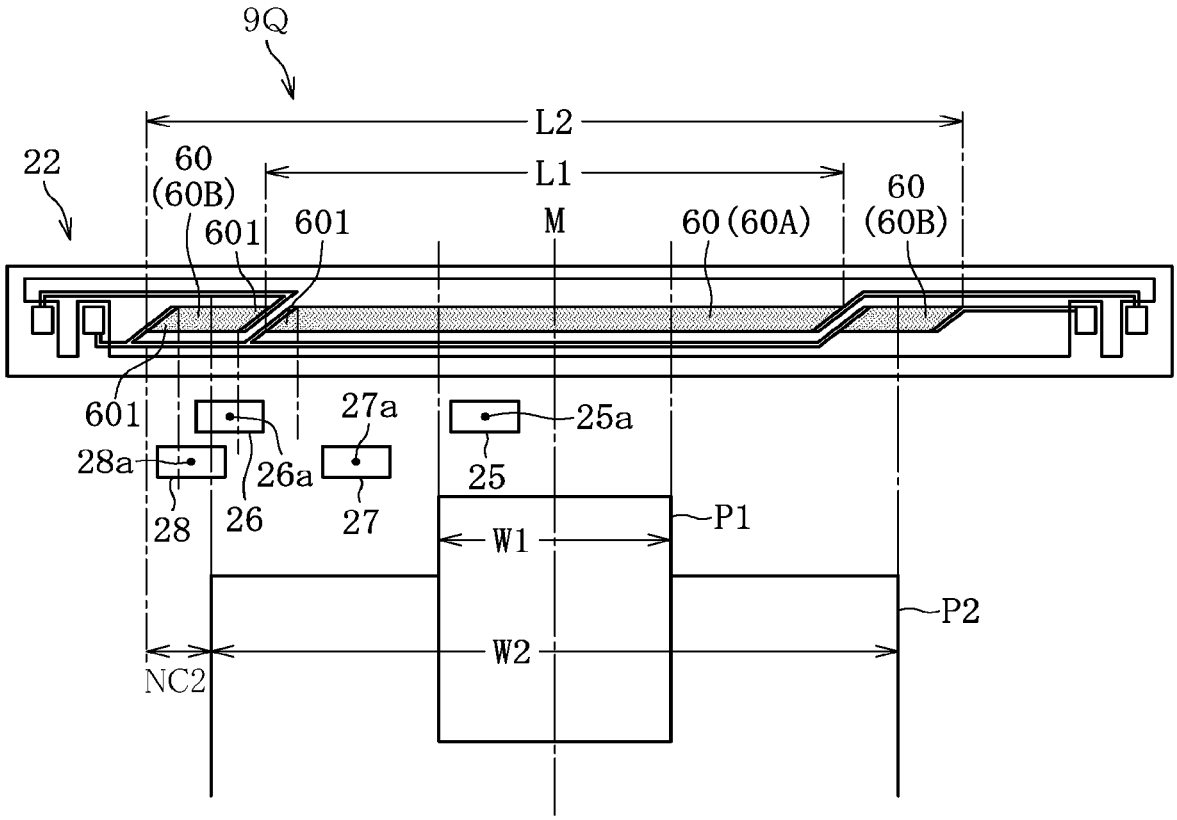
FIG. 18 is a plan view of a fixing device installable in the image forming apparatus depicted in FIG. 1, illustrating a fourth thermistor incorporated in the fixing device.

FIG. 18 illustrates a fixing device 9Q according to an embodiment, that includes a fourth thermistor 28 in addition to the first thermistor 25, the second thermistor 26, and the third thermistor 27. The fourth thermistor 28 is a non-conveyance span sensor serving as a non-conveyance span temperature detector that detects the temperature of the fixing belt 20 in a non-conveyance span NC2 (e.g., a non-passage span) of the lateral end heat generating portion 60B, where the sheets P are not conveyed. The fourth thermistor 28 includes a temperature detecting portion 28*a* disposed outboard from the conveyance span W2 where the large sheet P2 is conveyed and within a span of the lateral end heat generating portion 60B (e.g., the width span L2 encompassing both of the lateral end heat generating portions 60B) in the longitudinal direction of the heater 22. Accordingly, the fourth thermistor 28 detects the temperature of the fixing belt 20 in the non-conveyance span NC2 of the lateral end heat generating portion 60B, where the large sheet P2 is not conveyed.

In order to improve accuracy of temperature detection of the fourth thermistor 28, like the second thermistor 26 and the third thermistor 27, the temperature detecting portion 28*a* of the fourth thermistor 28 is preferably disposed opposite a portion of the lateral end heat generating portion 60B other than the slopes 601, for example, the center portion of the lateral end heat generating portion 60B in the longitudinal direction thereof.

Figure 19:
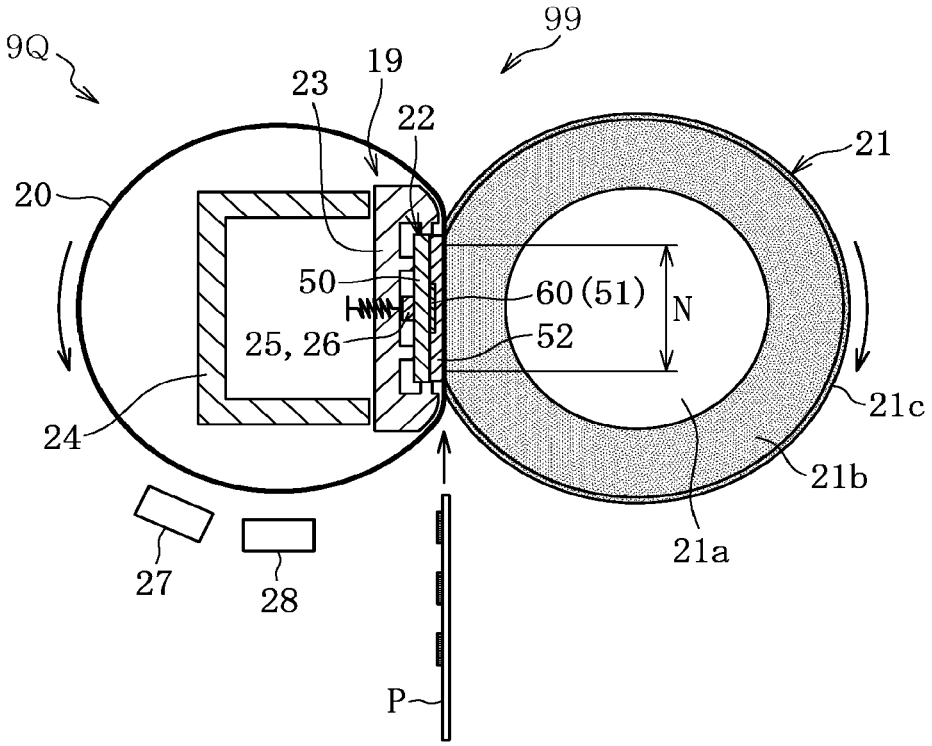
FIG. 19 is a cross-sectional view of the fixing device depicted in FIG. 18.

Like the third thermistor 27, the fourth thermistor 28 that detects the temperature of the fixing belt 20 in the non-conveyance span NC2 of the lateral end heat generating portion 60B is disposed opposite the outer circumferential surface of the fixing belt 20 so as to detect the temperature of the lubricant precisely as illustrated in FIG. 19. Accordingly, even when the lateral end heat generating portion 60B suffers from overheating in the non-conveyance span NC2, the fourth thermistor 28 detects the temperature of the fixing belt 20 in the non-conveyance span NC2 of the lateral end heat generating portion 60B, suppressing thermal degradation of the lubricant precisely.

As illustrated in FIG. 19, the fourth thermistor 28 does not contact the fixing belt 20. Alternatively, like the third thermistor 27 depicted in FIG. 10, the fourth thermistor 28 may also contact the inner circumferential surface of the fixing belt 20 directly. FIG. 19 illustrates the fourth thermistor 28 disposed at the entry to the fixing nip N. Alternatively, the fourth thermistor 28 may be disposed at the exit of the fixing nip N.

Figure 20:
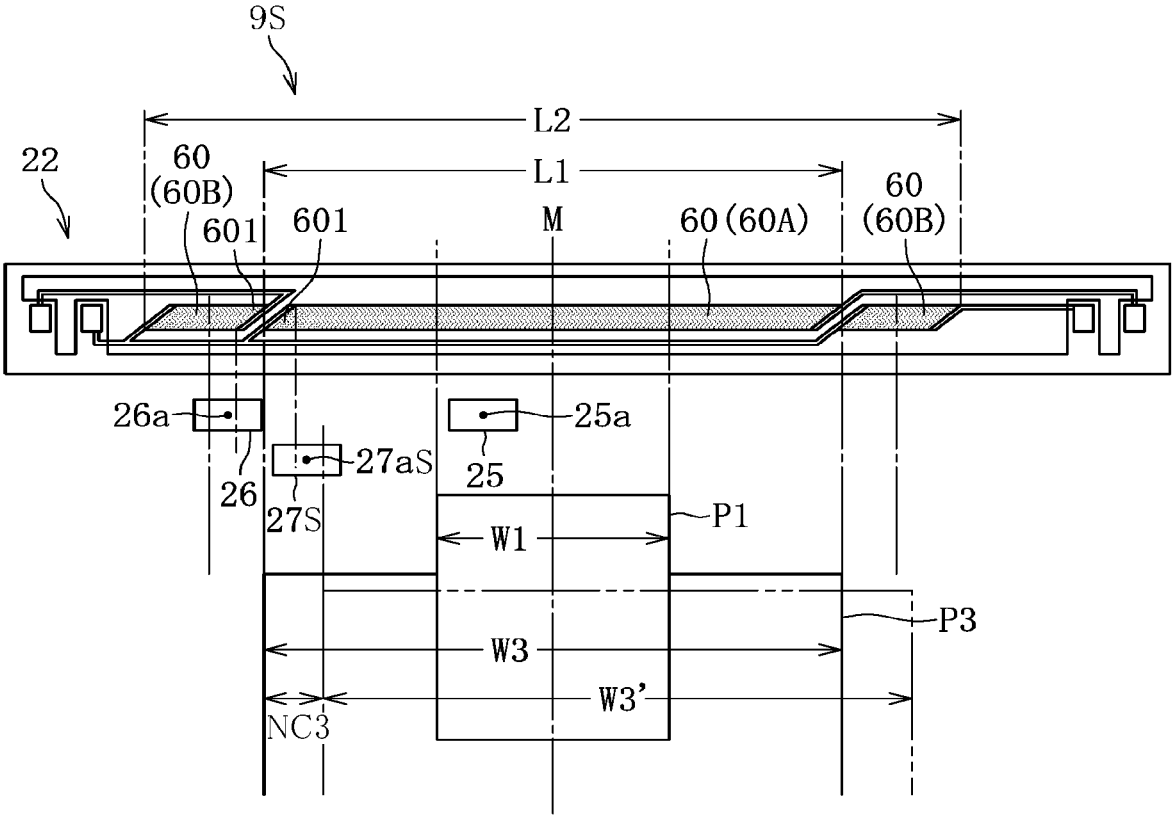
FIG. 20 is a diagram of a fixing device installable in the image forming apparatus depicted in FIG. 1, illustrating a third thermistor that detects a temperature of a non-conveyance span where a sheet is not conveyed when the sheet is placed erroneously.

FIG. 20 illustrates a fixing device 9S incorporating a third thermistor 27S. Even if a sheet P3 is placed erroneously, the third thermistor 27S detects temperature increase of a non-conveyance span NC3 where the sheet P3 is not conveyed. For example, the third thermistor 27S includes a temperature detecting portion 27*a* S disposed within the width span L1 of the center heat generating portion 60A. Additionally, the temperature detecting portion 27*a* S is disposed outboard from an erroneous conveyance span W3', where the sheet P3 is conveyed erroneously, in the longitudinal direction of the heater 22 to address erroneous placement of the sheet P3.

The sheet P3 may be erroneously aligned along one lateral end of the heater 22 in the longitudinal direction thereof and shifted from a proper position indicated with a solid line in FIG. 20 in a width direction of the sheet P3. In this case, the erroneous conveyance span W3' that appears when the sheet P3 is erroneously placed defines a conveyance span where the sheet P3 is conveyed in a state in which shifting of the sheet P3 is not corrected. To address this circumstance, according to this embodiment, the temperature detecting portion 27*a* S of the third thermistor 27S is disposed within the width span L1 of the center heat generating portion 60A and disposed outboard from the erroneous conveyance span W3' in the longitudinal direction of the heater 22. Accordingly, even if the sheet P3 is placed erroneously and conveyed, the third thermistor 27S detects the temperature of the fixing belt 20 in the non-conveyance span NC3 of the center heat generating portion 60A.

According to an example of the fixing device 9S illustrated in FIG. 20, the width span L1 of the center heat generating portion 60A is equivalent to a width of the sheet P3 in the longitudinal direction of the heater 22. Accordingly, if the sheet P3 is conveyed at the proper position indicated with the solid line in FIG. 20, the third thermistor 27S detects the temperature of the fixing belt 20 in a conveyance span W3 of the center heat generating portion 60A. Conversely, if the sheet P3 is conveyed at an improper position indicated with an alternate long and two short dashes line in FIG. 20, the third thermistor 27S detects the temperature of the fixing belt 20 in the non-conveyance span NC3 of the center heat generating portion 60A.

As described above, if the sheet P3 is placed erroneously, the third thermistor 27S detects a temperature of the fixing belt 20 in the non-conveyance span NC3. The temperature of the fixing belt 20 in the non-conveyance span NC3 is basically higher than a temperature of the fixing belt 20 in the conveyance span W3, that is detected by the third thermistor 27S when the sheet P3 is placed appropriately. The controller identifies a difference between the temperature of the fixing belt 20 in the non-conveyance span NC3 and the temperature of the fixing belt 20 in the conveyance span W3, that are detected by the third thermistor 27S, thus determining whether or not the sheet P3 is placed erroneously. If the controller determines that the sheet P3 is placed erroneously, the controller interrupts image formation and notifies a user of erroneous placement of the sheet P3 with an alarm or a message on a display, so that the user corrects erroneous placement of the sheet P3.

The configuration to determine whether or not the sheet P3 is erroneously placed is not limited to the configuration in which the width of the sheet P3 is equivalent to the width span L1 of the center heat generating portion 60A. If the paper type of the sheet P3 causes an opposed position of the third thermistor 27S to vary between a conveyance span and a non-conveyance span depending on whether or not the sheet P3 is erroneously placed, the controller identifies a difference between a temperature of the fixing belt 20 in the conveyance span and a temperature of the fixing belt 20 in the non-conveyance span, that are detected by the third thermistor 27S similarly, thus determining whether or not the sheet P is placed erroneously.

Figure 21:
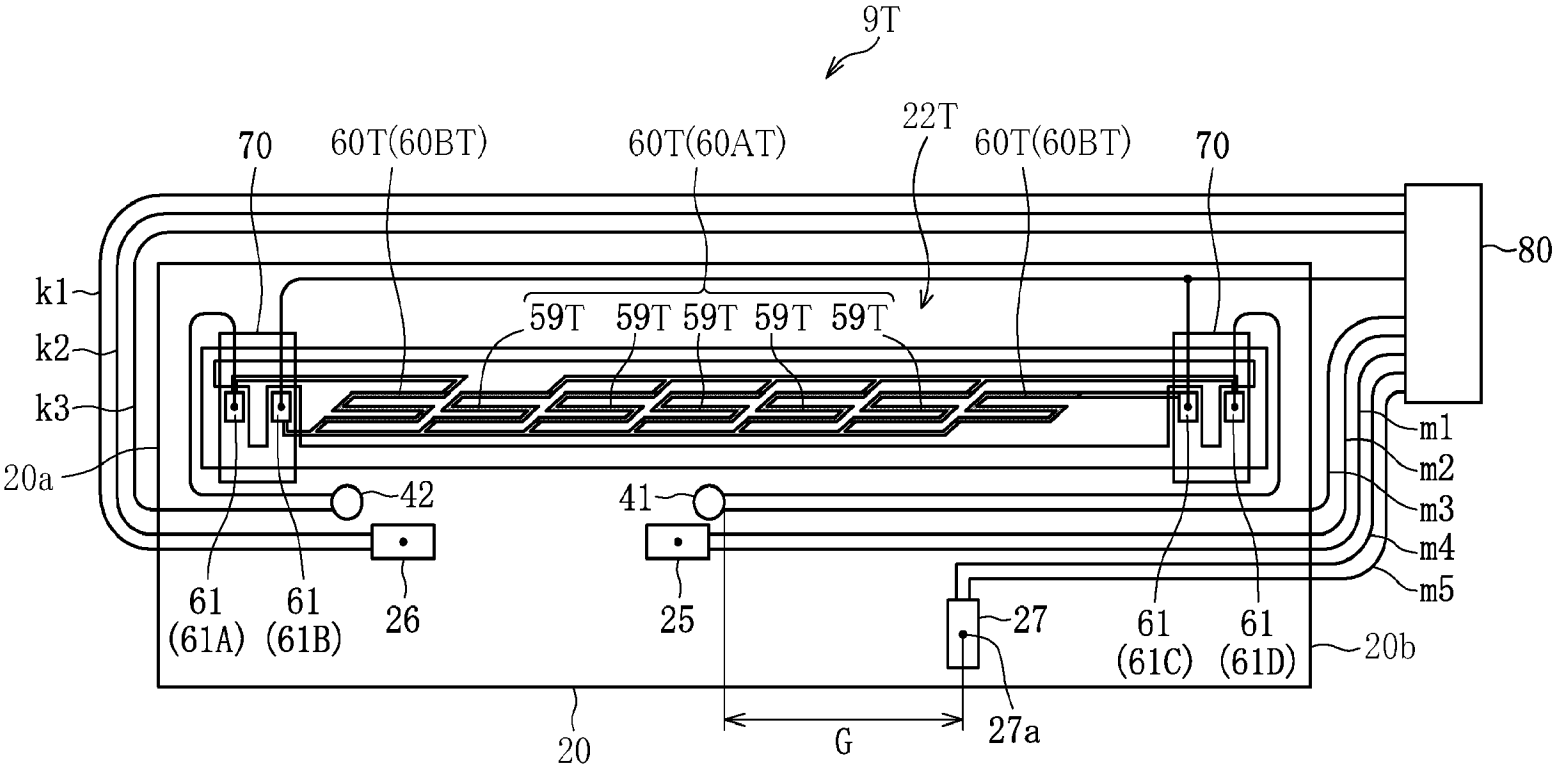
FIG. 21 is a diagram of a fixing device installable in the image forming apparatus depicted in FIG. 1, illustrating thermostats incorporated in the fixing device.

FIG. 21 illustrates a fixing device 9T incorporating two thermostats 41 and 42 in addition to the three thermistors, that is, the first thermistor 25, the second thermistor 26, and the third thermistor 27. The two thermostats 41 and 42 serve as power interrupters that interrupt power supply to the center heat generating portion 60AT and the lateral end heat generating portions 60BT when the thermostats 41 and 42 detect that temperatures of the center heat generating portion 60AT and the lateral end heat generating portion 60BT are predetermined temperatures or higher, respectively. For example, each of the thermostats 41 and 42 contacts a back face of the heater 22T. One of the two thermostats, that is, the thermostat 41, is electrically connected to the electrode 61D that supplies power to the center heat generating portion 60AT. Another one of the two thermostats, that is, the thermostat 42, is electrically connected to the electrode 61A that supplies power to the lateral end heat generating portion 60BT. When the thermostats 41 and 42 detect that the center heat generating portion 60AT and the lateral end heat generating portion 60BT suffer from overheating, the thermostats 41 and 42 interrupt power supply to the center heat generating portion 60AT and the lateral end heat generating portions 60BT, thus interrupting heat generation of the heater 22T. Alternatively, a fuse may be used as a power interrupter, instead of the thermostats 41 and 42.

As illustrated in FIG. 21, the center heat generating portion 60AT is constructed of the plurality of heat generating blocks 59T connected in parallel. Hence, the thermostat 41 disposed opposite the center heat generating portion 60AT is preferably disposed opposite the identical heat generating block 59T disposed opposite the first thermistor 25. Since the thermostat 41 and the first thermistor 25 are disposed opposite the identical heat generating block 59T, even if the identical heat generating block 59T suffers from disconnection and the thermostat 41 does not detect overheating, the first thermistor 25 detects abnormal temperature decrease caused by disconnection, identifying failure of the heater 22T.

According to an example of the fixing device 9T illustrated in FIG. 21, a predetermined interval G is provided between the temperature detecting portion 27*a* of the third thermistor 27 and the thermostat 41, that is closer to the third thermistor 27 than the thermostat 42 is, in the width direction of the fixing belt 20. Each of the thermostats 41 and 42 includes a metallic face that contacts the back face of the heater 22T directly. Accordingly, each of the thermostats 41 and 42 absorbs heat from the heater 22T at a contact portion of the heater 22T, that contacts each of the thermostats 41 and 42, and a vicinity of the contact portion, thus decreasing temperature of the heater 22T. Hence, if the third thermistor 27 is disposed opposite the contact portion of the heater 22T, that contacts each of the thermostats 41 and 42, and the vicinity of the contact portion, the third thermistor 27 may not detect a highest temperature of the fixing belt 20 in the non-conveyance span NC1 easily.

To address this circumstance, according to the example of the fixing device 9T illustrated in FIG. 21, the temperature detecting portion 27*a* of the third thermistor 27 is spaced from the thermostat 41, that is closer to the third thermistor 27 than the thermostat 42 is, in the width direction of the fixing belt 20. Accordingly, the third thermistor 27 is not adversely affected by a decreased temperature of the fixing belt 20 that is decreased by the thermostat 41. The third thermistor 27 is spaced from the thermostat 41 with a length of the interval G between the third thermistor 27 and the thermostat 41, that is preferably 10 mm or greater, to prevent the third thermistor 27 from being adversely affected by the decreased temperature of the fixing belt 20. The length of the interval G is preferably 30 mm or smaller in view of a layout of the fixing device 9T. Alternatively, if a thermostat is disposed opposite one lateral end of the fixing belt 20 in the width direction thereof, the third thermistor 27 may be disposed opposite another lateral end of the fixing belt 20 in the width direction thereof. Yet alternatively, in order to suppress temperature decrease of the heater 22T, that is caused by a thermostat contacting the heater 22T, the thermostat may contact the heater 22T via an element having a thermal conductivity smaller than a thermal conductivity of the thermostat.

In the fixing device 9T illustrated in FIG. 21, the fixing belt 20 accommodates the two thermostats 41 and 42 inside the loop formed by the fixing belt 20, in addition to the first thermistor 25, the second thermistor 26, and the third thermistor 27, increasing the number of wires disposed inside the loop formed by the fixing belt 20. Accordingly, if the wires coupled to the external device 80 such as the controller and the power supply are exposed to an outside of the fixing belt 20 from one lateral end of the fixing belt 20 in the axial direction thereof, wiring may not be performed easily with the fixing belt 20 having a decreased diameter, for example, thus degrading operation. Additionally, the wires occupy space inside the loop formed by the fixing belt 20, hindering decreasing of the diameter of the fixing belt 20.

To address this circumstance, in the fixing device 9T illustrated in FIG. 21, a part of the plurality of wires coupled to the first thermistor 25, the second thermistor 26, the third thermistor 27, and the thermostats 41 and 42, that is, wires k1, k2, and k3, are exposed to the outside of the fixing belt 20 from one lateral end, that is, a lateral end 20*a*, of the fixing belt 20 in the axial direction thereof. Other part of the plurality of wires coupled to the first thermistor 25, the second thermistor 26, the third thermistor 27, and the thermostats 41 and 42, that is, wires m1, m2, m3, m4, and m5, are exposed to the outside of the fixing belt 20 from another lateral end, that is, a lateral end 20*b*, of the fixing belt 20 in the axial direction thereof. As described above, the wires are divided into the wires k1, k2, and k3 exposed from the lateral end 20*a* of the fixing belt 20 and the wires m1, m2, m3, m4, and m5 exposed from the lateral end 20*b* of the fixing belt 20. Accordingly, the wires k1, k2, k3, m1, m2, m3, m4, and m5 prevent degradation in wiring caused by concentration of wires at one lateral end of the fixing belt 20 and facilitate downsizing of the fixing belt 20.

As described above, in the fixing devices 9, 9Q, 9S, and 9T according to the embodiments described above, while a sheet P having a particular width is conveyed through the fixing nip N, a partial span of a heat generator (e.g., the heat generators 60, 60S, and 60T) defines a conveyance span (e.g., the conveyance spans W1, W2, and W3). Another partial span of the heat generator defines a non-conveyance span (e.g., the non-conveyance spans NC1, NC2, and NC3). A thermistor (e.g., the third thermistors 27 and 27S and the fourth thermistor 28) that detects the temperature of the non-conveyance span detects the temperature of the fixing belt 20. Accordingly, the thermistor detects the temperature of the lubricant precisely, thus suppressing thermal degradation of the lubricant precisely. The thermistor is situated at a position where the thermistor detects the temperature of the fixing belt 20. Accordingly, compared to a thermistor situated at a position where the thermistor detects the temperature of a heater (e.g., the heaters 22, 22S, 22T, and 22U), the thermistor situated at the position where the thermistor detects the temperature of the fixing belt 20 suppresses temperature increase of the thermistor and reduces degradation and breakage of the thermistor. Since the thermistor suppresses temperature increase thereof, the thermistor that has a decreased heat resistance is employed, reducing manufacturing costs.

The embodiments of the present disclosure are more advantageous if the embodiments are applied to a heater having a positive temperature coefficient (PTC) property. For example, when the heater having the PTC property suffers from temperature increase in the non-conveyance span, the resistance value increases in the non-conveyance span. Accordingly, the heater increases a heat generation amount further and suffers from substantial temperature increase, causing the lubricant to be subject to temperature increase. To address this circumstance, with the heater having the PTC property, the thermistor that detects the temperature of the non-conveyance span detects the temperature of the fixing belt 20. Accordingly, the thermistor detects the temperature of the lubricant precisely and quickly, thus suppressing thermal degradation of the lubricant precisely. Temperature increase of the non-conveyance span caused by the PTC property occurs similarly in the heaters 22S, 22T, and 22U depicted in FIGS. 15 to 17, respectively, and the like in addition to the heater 22 depicted in FIG. 4 if the electric current flows at least in longitudinal directions of the heaters 22S, 22T, and 22U, that is, the width direction of the sheet P.

Figure 22:
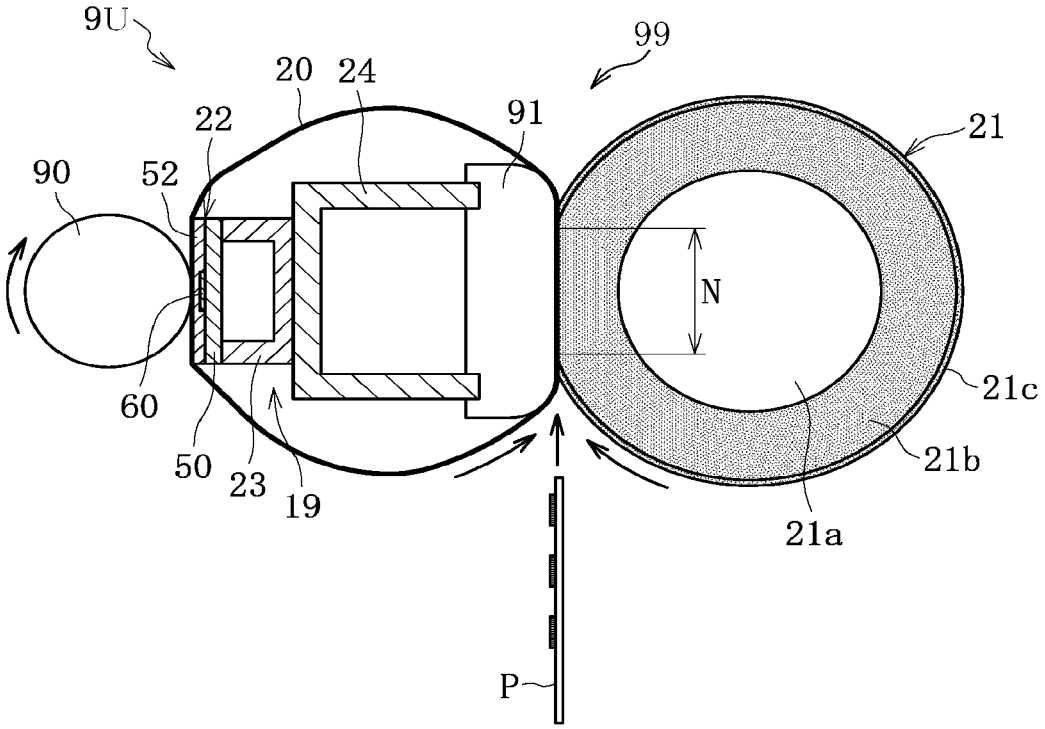
FIG. 22 is a schematic cross-sectional view of a fixing device as a first variation of the fixing device depicted in FIG. 2.
Figure 23:
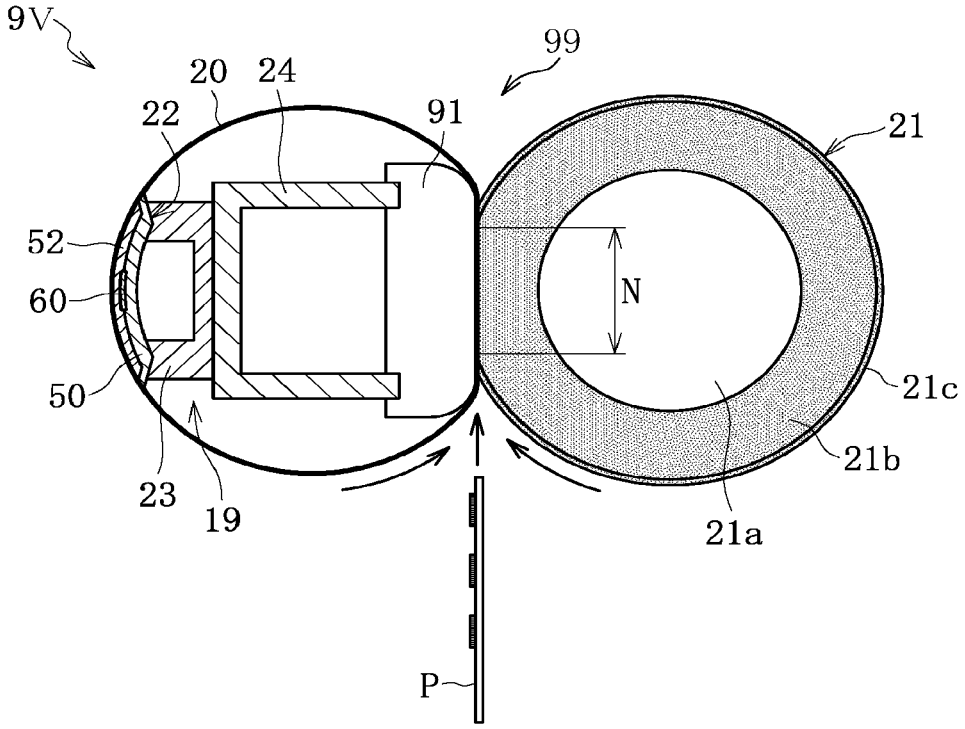
FIG. 23 is a schematic cross-sectional view of a fixing device as a second variation of the fixing device depicted in FIG. 2.
Figure 24:
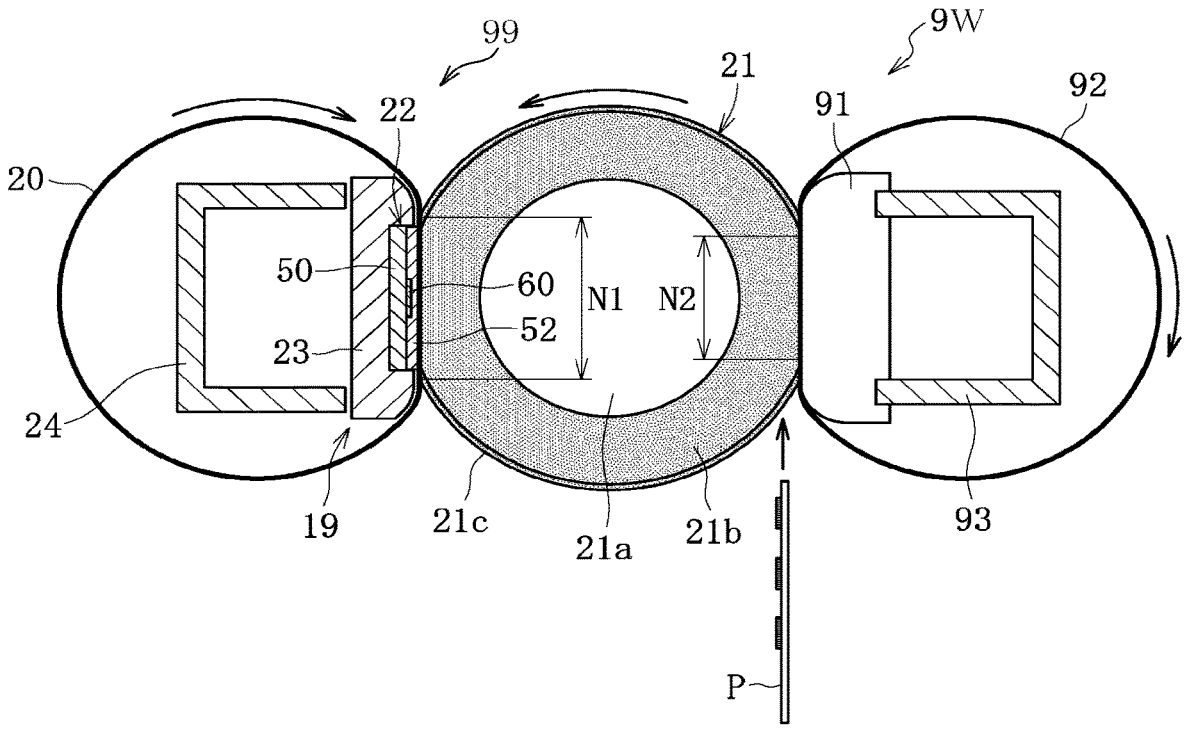
FIG. 24 is a schematic cross-sectional view of a fixing device as a third variation of the fixing device depicted in FIG. 2.

The embodiments of the present disclosure are applicable to fixing devices 9U, 9V, and 9W illustrated in FIGS. 22 to 24, respectively, other than the fixing devices 9, 9P, 9Q, 9S, and 9T described above. The following briefly describes a construction of each of the fixing devices 9U, 9V, and 9W depicted in FIGS. 22 to 24, respectively.

A description is provided of the construction of the fixing device 9U.

As illustrated in FIG. 22, the fixing device 9U includes a pressing roller 90 disposed opposite the pressure roller 21 via the fixing belt 20. The pressing roller 90 and the heater 22 sandwich the fixing belt 20 so that the heater 22 heats the fixing belt 20. On the other hand, a nip forming pad 91 is disposed inside the loop formed by the fixing belt 20 and disposed opposite the pressure roller 21. The stay 24 supports the nip forming pad 91. The nip forming pad 91 and the pressure roller 21 sandwich the fixing belt 20 and define the fixing nip N.

A description is provided of the construction of the fixing device 9V depicted in FIG. 23.

As illustrated in FIG. 23, the fixing device 9V does not include the pressing roller 90 described above with reference to FIG. 22. In order to attain a contact length for which the heater 22 contacts the fixing belt 20 in a circumferential direction thereof, the heater 22 is curved into an arc in cross section that corresponds to a curvature of the fixing belt 20. Other construction of the fixing device 9V is equivalent to that of the fixing device 9U depicted in FIG. 22.

A description is provided of the construction of the fixing device 9W depicted in FIG. 24.

As illustrated in FIG. 24, the fixing device 9W includes a pressure belt 92 in addition to the fixing belt 20. The pressure belt 92 and the pressure roller 21 form a fixing nip N2 serving as a secondary nip separately from a heating nip N1 serving as a primary nip formed between the fixing belt 20 and the pressure roller 21. For example, the nip forming pad 91 and a stay 93 are disposed opposite the fixing belt 20 via the pressure roller 21. The pressure belt 92 that is rotatable accommodates the nip forming pad 91 and the stay 93. As a sheet P bearing a toner image is conveyed through the fixing nip N2 formed between the pressure belt 92 and the pressure roller 21, the pressure belt 92 and the pressure roller 21 fix the toner image on the sheet P under heat and pressure. Other construction of the fixing device 9W is equivalent to that of the fixing device 9 depicted in FIG. 2.

The above describes the constructions of various fixing devices (e.g., the fixing devices 9, 9P, 9Q, 9S, 9T, 9U, 9V, and 9W) that incorporate the heaters (e.g., the heaters 22, 22S, 22T, and 22U). However, the heaters according to the embodiments of the present disclosure are also applicable to devices other than the fixing devices. For example, the heaters 22, 22S, 22T, and 22U according to the embodiments of the present disclosure are also applicable to a dryer installed in an image forming apparatus employing an inkjet method. The dryer dries ink applied onto a sheet. The heating device 99 according to the embodiments of the present disclosure is not limited to a heating device that heats a sheet P as a heating target. For example, the heating device 99 according to the embodiments of the present disclosure may be applied to a coater (e.g., a laminator) that laminates and thermally presses film as a coating member onto a surface of a sheet (e.g., paper).

A description is provided of advantages of a heating device (e.g., the heating device 99).

As illustrated in FIGS. 2, 7, and 10 to 24, the heating device includes a heater (e.g., the heaters 22, 22S, 22T, and 22U), an endless belt (e.g., the fixing belt 20 and the pressure belt 92), a pressure rotator (e.g., the pressure roller 21), and a non-conveyance span temperature detector (e.g., the third thermistors 27 and 27S and the fourth thermistor 28).

The heater is a laminated heater, for example. The heater includes a heat generator (e.g., the heat generators 60, 60S, and 60T) that includes a plurality of heat generating portions (e.g., the center heat generating portions 60A, 60AS, and 60AT and the lateral end heat generating portions 60B and 60BT) controlled to generate heat separately from each other. The endless belt is rotatable in a rotation direction. The pressure rotator is rotatable in a rotation direction and contacts an outer circumferential surface of the endless belt to form a nip (e.g., the fixing nips N and N2) therebetween. A lubricant is interposed between the endless belt and the heater.

When the heater heats a heating target (e.g., a sheet P), having a predetermined width in a longitudinal direction of the heater, that is conveyed through the nip, the heat generator defines a partial span as a conveyance span (e.g., the conveyance spans W1, W2, W3, and W3') in the longitudinal direction of the heater, where the heating target is conveyed. The heat generator further defines other span as a non-conveyance span (e.g., the non-conveyance spans NC1, NC2, and NC3) in the longitudinal direction of the heater, where the heating target is not conveyed. The non-conveyance span is different from the conveyance span. The non-conveyance span temperature detector is disposed opposite the endless belt in the non-conveyance span of the heat generator and detects a temperature of the endless belt.

The non-conveyance span temperature detector detects the temperature of the endless belt in a span of the endless belt, that corresponds to the non-conveyance span of the heat generator, thus detecting the temperature of the lubricant precisely.

According to the embodiments described above, the fixing belt 20 serves as an endless belt. Alternatively, a fixing film, a fixing sleeve, or the like may be used as an endless belt. Further, the pressure roller 21 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A heating device, comprising:

an endless belt configured to rotate in a rotation direction;

a pressure rotator configured to contact an outer circumferential surface of the endless belt to form a nip between the endless belt and the pressure rotator;

a heater configured to sandwich a lubricant together with the endless belt, the heater including a heat generator configured to define:

a conveyance span in a longitudinal direction of the heater, the conveyance span being where a heating target having a predetermined width in the longitudinal direction of the heater is conveyed through the nip; and a non-conveyance span in the longitudinal direction of the heater, the non-conveyance span being where the heating target is not conveyed; and a non-conveyance span temperature detector disposed facing an inner circumferential surface of the endless belt in the non-conveyance span of the heat generator and downstream from the nip in the rotation direction of the endless belt, the non-conveyance span temperature detector configured to detect a temperature of the endless belt.

2. The heating device according to claim 1, wherein the heat generator includes:

a first heat generating portion; and a second heat generating portion arranged with the first heat generating portion in the longitudinal direction of the heater.

3. The heating device according to claim 2, further comprising a controller configured to control the first heat generating portion and the second heat generating portion to generate heat separately.

4. The heating device according to claim 2, wherein the first heat generating portion includes a center heat generating portion disposed at a center of the heat generator in the longitudinal direction of the heater, the center heat generating portion configured to generate heat of a first amount, wherein the second heart generating portion includes a lateral end heat generating portion disposed at a lateral end of the heat generator in the longitudinal direction of the heater, the lateral end heat generating portion configured to generate heat of a second amount smaller than the first amount of the center heat generating portion, and wherein the non-conveyance span temperature detector is disposed opposite the center heat generating portion in the longitudinal direction of the heater.

5. The heating device according to claim 1, wherein the non-conveyance span temperature detector detects the temperature of the inner circumferential surface of the endless belt.

6. The heating device according to claim 1, wherein the non-conveyance span temperature detector contacts the inner circumferential surface of the endless belt.

7. The heating device according to claim 1, wherein the endless belt includes:

a base made of metal; and an elastic layer disposed on an outer periphery of the base.

8. The heating device according to claim 1, wherein the non-conveyance span temperature detector includes:

a temperature detecting element configured to detect the temperature of the endless belt; and an insulating sheet interposed between the temperature detecting element and the endless belt.

9. The heating device according to claim 8, wherein the insulating sheet covers the temperature detecting element, and wherein the insulating sheet includes:

a first face; and a second face configured to adhere to the first face in a periphery of the temperature detecting element.

10. The heating device according to claim 1, further comprising a power interrupter disposed opposite the heater, the power interrupter configured to detect a temperature of the heat generator and interrupt power supply to the heat generator when the temperature of the heat generator is a predetermined temperature or higher.

11. The heating device according to claim 10, wherein the non-conveyance span temperature detector is spaced from the power interrupter with an interval between the non-conveyance span temperature detector and the power interrupter in an axial direction of the endless belt, the interval having a length of 10 mm or greater.

12. The heating device according to claim 10, wherein the non-conveyance span temperature detector is disposed opposite one lateral end of the endless belt in an axial direction of the endless belt, and wherein the power interrupter is disposed opposite another lateral end of the endless belt in the axial direction of the endless belt.

13. The heating device according to claim 1, wherein a plurality of heating targets having a plurality of widths in the longitudinal direction of the heater, respectively, is conveyed through the nip, and wherein the predetermined width of the heating target defines a minimum width of the plurality of widths.

14. The heating device according to claim 1, wherein a heating target having a width greater than the predetermined width is conveyed through the nip and shifted from a proper position in the longitudinal direction of the heater, and wherein the non-conveyance span temperature detector is disposed opposite the endless belt in another non-conveyance span in the longitudinal direction of the heater, said another non-conveyance span being where the heating target having the width greater than the predetermined width is not conveyed.

15. The heating device according to claim 1, further comprising a conveyance span temperature detector disposed opposite the heater in the conveyance span of the heat generator, the conveyance span temperature detector configured to detect a temperature of the heater.

16. The heating device according to claim 15, wherein the conveyance span temperature detector does not contact the heater.

17. The heating device according to claim 1, wherein the heat generator has a positive temperature coefficient property, and wherein an electric current flows through at least a part of the heat generator in the longitudinal direction of the heater.

18. A fixing device, comprising:

an endless belt configured to rotate in a rotation direction;

a pressure rotator configured to contact an outer circumferential surface of the endless belt to form a nip between the endless belt and the pressure rotator;

a laminated heater configured to sandwich a lubricant together with the endless belt, the laminated heater including a heat generator configured to define:

a conveyance span in a longitudinal direction of the laminated heater, the conveyance span being where a recording medium having a predetermined width in the longitudinal direction of the laminated heater is conveyed through the nip; and a non-conveyance span in the longitudinal direction of the laminated heater, the non-conveyance span being where the recording medium is not conveyed; and a non-conveyance span temperature detector disposed facing an inner circumferential surface of the endless belt in the non-conveyance span of the heat generator and downstream from the nip in the rotation direction of the endless belt, the non-conveyance span temperature detector configured to detect a temperature of the endless belt.

19. An image forming apparatus comprising:

an image forming device configured to form an image; and a heating device configured to heat the image borne on a heating target, the heating device including:

an endless belt configured to rotate in a rotation direction;

a pressure rotator configured to contact an outer circumferential surface of the endless belt to form a nip between the endless belt and the pressure rotator;

a heater configured to sandwich a lubricant together with the endless belt, the heater including a heat generator configured to define:

a conveyance span in a longitudinal direction of the heater, the conveyance span being where the heating target having a predetermined width in the longitudinal direction of the heater is conveyed through the nip; and a non-conveyance span in the longitudinal direction of the heater, the non-conveyance span being where the heating target is not conveyed; and a non-conveyance span temperature detector disposed facing an inner circumferential surface of the endless belt in the non-conveyance span of the heat generator and downstream from the nip in the rotation direction of the endless belt, the non-conveyance span temperature detector configured to detect a temperature of the endless belt.

20. A heating device, comprising:

an endless belt configured to rotate in a rotation direction;

a pressure rotator configured to contact an outer circumferential surface of the endless belt to form a nip between the endless belt and the pressure rotator;

a heater configured to sandwich a lubricant together with the endless belt, the heater including a heat generator configured to define:

a conveyance span in a longitudinal direction of the heater, the conveyance span being where a heating target having a predetermined width in the longitudinal direction of the heater is conveyed through the nip; and a. non-conveyance span in the longitudinal direction of the heater, the non-conveyance span being where the heating target is not conveyed; and a non-conveyance span temperature detector disposed opposite the endless belt in the non-conveyance span of the heat generator, the non-conveyance span temperature detector configured to detect a temperature of the endless belt, wherein a heating target having a width greater than the predetermined width is conveyed through the nip and shifted from a proper position in the longitudinal direction of the heater, and the non-conveyance span temperature detector is disposed opposite the endless belt in another non-conveyance span in the longitudinal direction of the heater, said another non-conveyance span being where the heating target having the width greater than the predetermined width is not conveyed.

* * * * *